US008456037B2

(12) United States Patent
Akiba et al.

(10) Patent No.: US 8,456,037 B2
(45) Date of Patent: Jun. 4, 2013

(54) SHUNT SWITCH, SEMICONDUCTOR DEVICE, MODULE AND ELECTRONIC DEVICE

(75) Inventors: Akira Akiba, Kanagawa (JP); Koichi Ikeda, Kanagawa (JP)

(73) Assignee: Sony Corporation, Tokyo (JP)

( * ) Notice: Subject to any disclaimer, the term of this patent is extended or adjusted under 35 U.S.C. 154(b) by 331 days.

(21) Appl. No.: 12/838,526

(22) Filed: Jul. 19, 2010

(65) Prior Publication Data

US 2011/0024273 A1 Feb. 3, 2011

(30) Foreign Application Priority Data

Jul. 28, 2009 (JP) ..... 2009-175190

(51) Int. Cl.
*G05F 1/10* (2006.01)
*H01H 51/34* (2006.01)

(52) U.S. Cl.
USPC ..... 307/98; 200/181; 333/205

(58) Field of Classification Search
USPC ..... 307/98, 100; 200/181; 333/205
See application file for complete search history.

(56) References Cited

U.S. PATENT DOCUMENTS

| | | | | |
|---|---|---|---|---|
| 7,061,315 | B2 * | 6/2006 | Merrill | 330/124 D |
| 2008/0078662 | A1 * | 4/2008 | Naito et al. | 200/181 |
| 2008/0111652 | A1 * | 5/2008 | Abbaspour-Tamijani et al. | 333/205 |

FOREIGN PATENT DOCUMENTS

| | | |
|---|---|---|
| JP | 2003-264122 | 9/2003 |

* cited by examiner

*Primary Examiner* — Rexford Barnie
*Assistant Examiner* — Toan Vu
(74) *Attorney, Agent, or Firm* — Sony Corporation

(57) ABSTRACT

A shunt switch allowed to improve isolation, a semiconductor device, a module and an electronic device each of which includes the shunt switch are provided. The shunt switch includes: a transmission line, a ground; and a shunt line electrically coupling the transmission line and the ground, in which two or more of the shunt lines are arranged in parallel to one another, and an impedance between the two or more shunt lines is higher than an impedance of the transmission line.

11 Claims, 23 Drawing Sheets

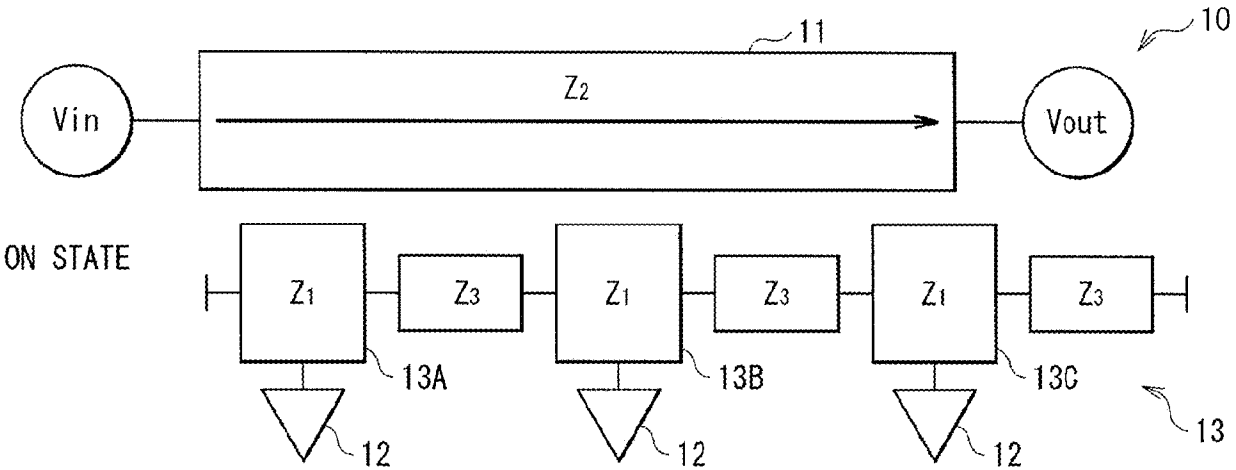
FIG. 1A ON STATE
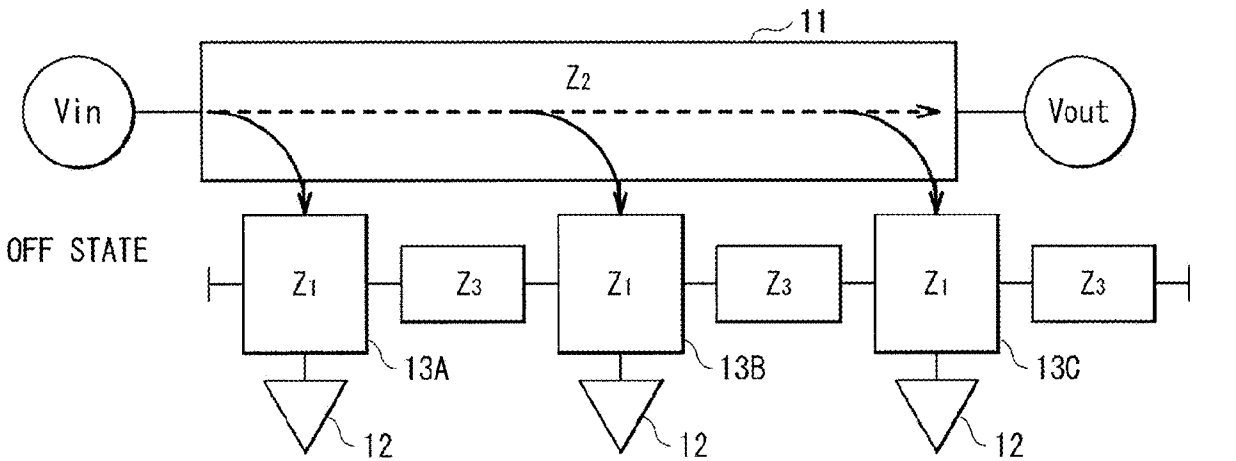
FIG. 1B OFF STATE

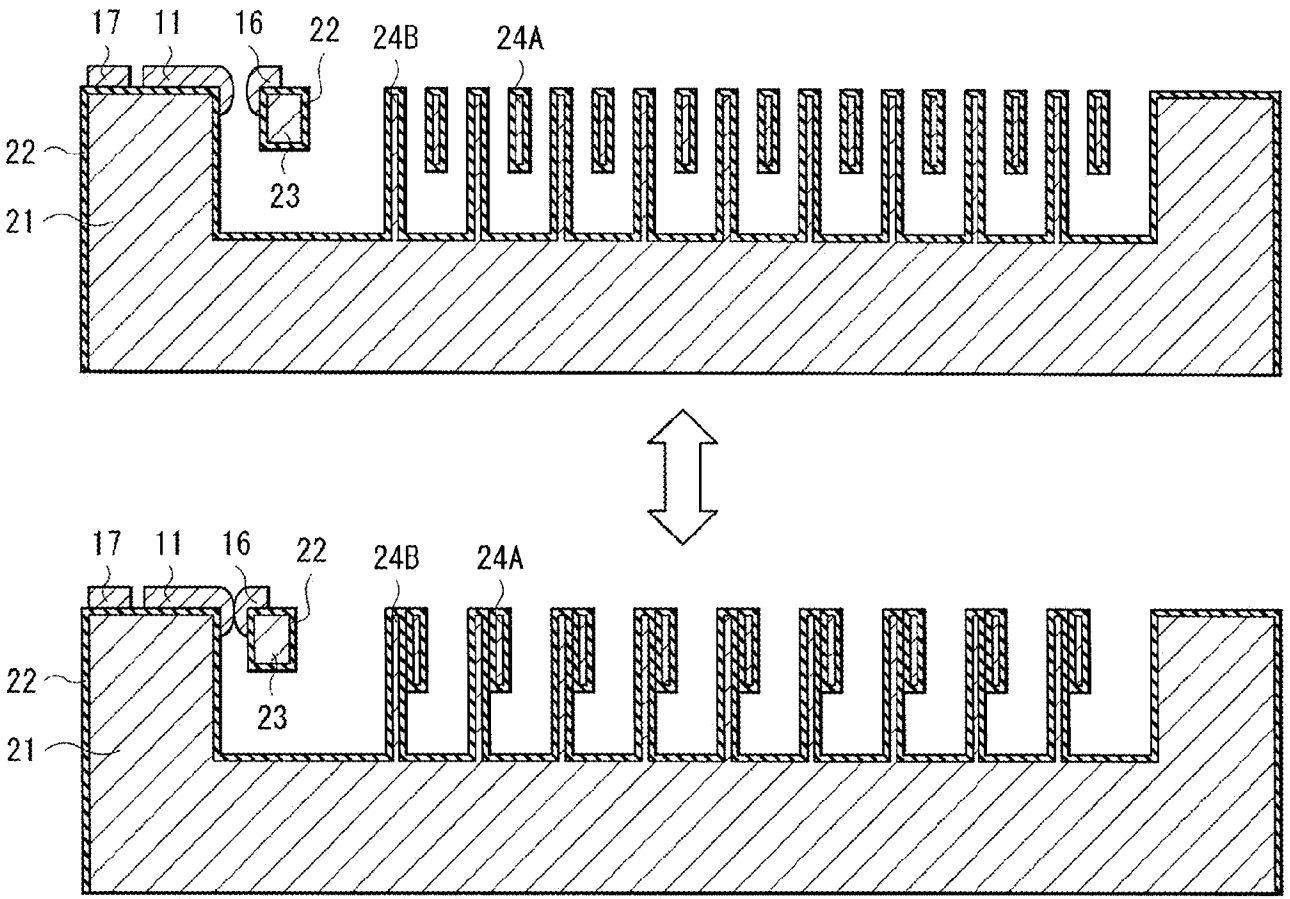
FIG. 16A ON STATE
FIG. 16B OFF STATE

CONFIGURATION IN FIGS. 2A AND 2B

FIRST EMBODIMENT

CONFIGURATION IN FIGS. 2A AND 2B

CONFIGURATION OF MODIFICATION 1

ON STATE

OFF STATE

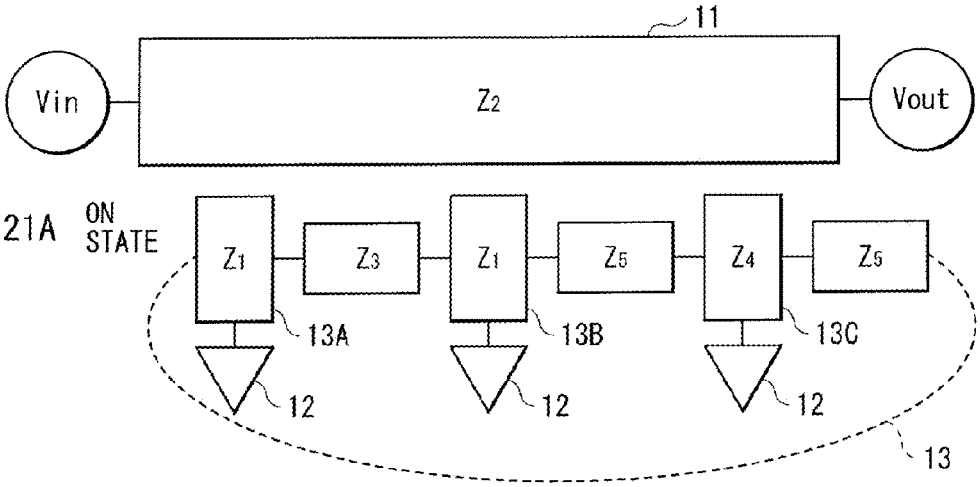
FIG. 21A ON STATE
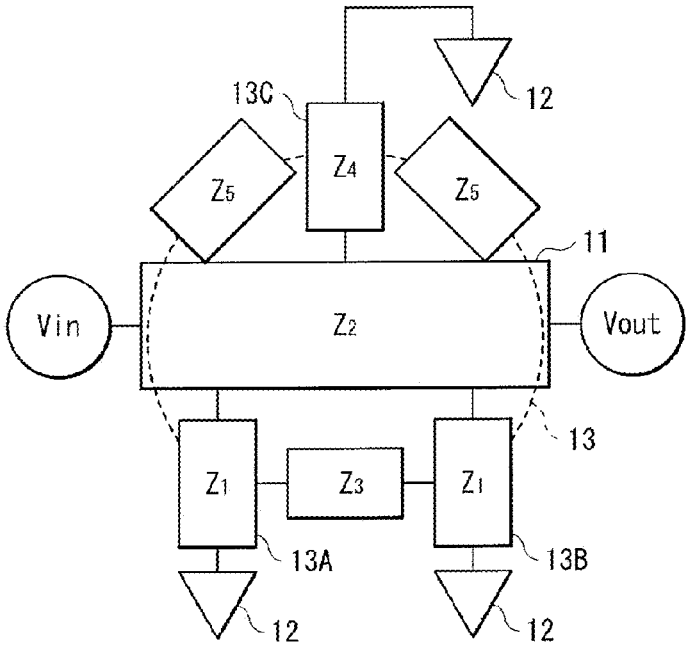
FIG. 21B OFF STATE

CONFIGURATION IN FIGS. 2A AND 2B

SECOND EMBODIMENT

FIG. 27A OFF STATE
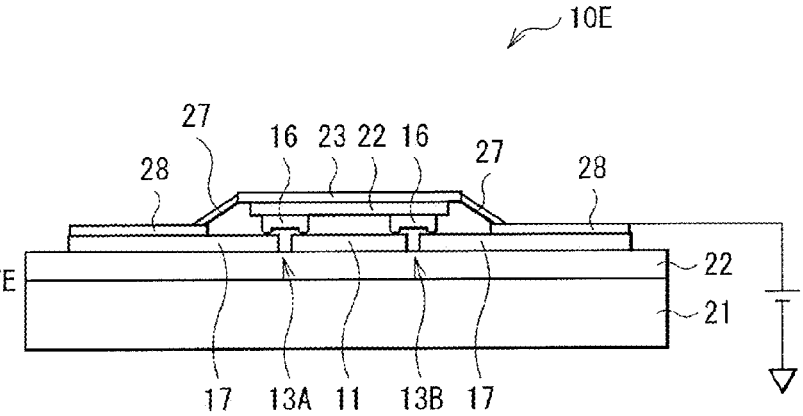
FIG. 27B ON STATE
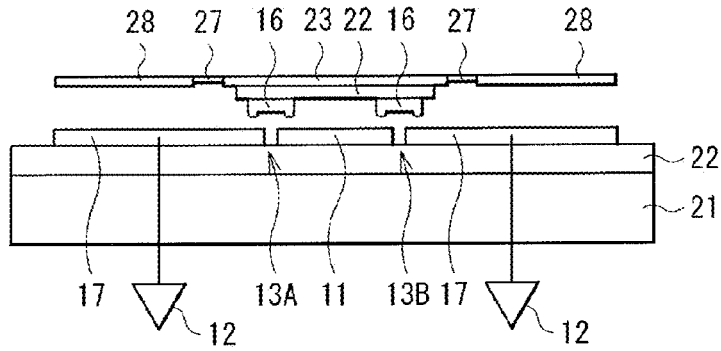

SHUNT SWITCH, SEMICONDUCTOR DEVICE, MODULE AND ELECTRONIC DEVICE

BACKGROUND OF THE INVENTION

1. Field of the Invention

The present invention relates to a shunt switch using MEMS (Micro Electro Mechanical Systems: micromachine), a semiconductor device, a module and an electronic device each of which includes the shunt switch.

2. Description of the Related Art

With a recent improvement in integration technology, technology for electronic devices to reduce their sizes and weights and achieve lower voltage operation, lower power consumption and higher frequency operation is advancing rapidly. In particular, in technology for mobile communication devices such as cellular phones, in addition to the above-described rigorous demands, higher performance is demanded, so as one of techniques for solving these conflicting issues, attention has been given to MEMS. The MEMS are systems in which a micro-mechanical element and an electronic circuit element are integrated by a silicon process technique, and in Japan, the MEMS are mostly called micromachine. Small and low-cost SoCs (Systems-on-a-chip) with higher performance are achievable by superior characteristics such as high precision processing of MEMS technology.

In the technology of mobile communication devices, various semiconductor devices using MEMS technology have been developed, and one of them is a switch for mechanically connecting and disconnecting a signal line which transmits a high-frequency signal. In switches for high frequency in related art, a shunt type switch in which a transmission line is connected to a ground through a shunt line in an OFF state as described in, for example, Japanese Unexamined Patent Application Publication No. 2003-264122 is used more widely than a series type switch in which a transmission line is physically disconnected in an OFF state.

For example, in a shunt switch in Japanese Unexamined Patent Application Publication No. 2003-264122, while a transmission line and a ground line are arranged on a substrate, a moving electrode as a shunt line is arranged above the substrate, and the transmission line is connected to a ground by bringing the moving electrode into contact with the transmission line and the ground line.

SUMMARY OF THE INVENTION

However, in such a shunt switch for high frequency in related art, typically, frequency characteristics of insertion loss are good, but frequency characteristics of isolation are poor. The isolation of the shunt switch is defined as 10 Log (Z1/Z2) with use of an impedance Z1 of a shunt line and an impedance Z2 of a transmission line, and typically an isolation of −20 dB to −40 dB is necessary. The impedance Z2 of the transmission line has an upper limit so as to keep an insertion loss approximately 1 dB, so in order to improve isolation, it is desirable to reduce only the impedance Z1 of the shunt line. However, in related art, it is difficult to reduce the impedance Z1 of the shunt line while maintaining the impedance Z2 of the transmission line.

In other words, the impedance Z1 of the shunt line is allowed to be reduced, for example, by increasing the dimensions of the moving electrode as the shunt line to increase a contact area with the transmission line. However, in such a case, the resistance of a path where a signal returns to the transmission line through the shunt line is also reduced, thereby a so-called return signal is easily generated.

It is desirable to provide a shunt switch allowed to improve isolation.

Moreover, it is desirable to provide a semiconductor device, a module and an electronic device each of which includes the shunt switch.

According to an embodiment of the invention, there is provided a shunt switch including: a transmission line, a ground; and a shunt line electrically coupling the transmission line and the ground, in which two or more of the shunt lines are arranged in parallel to one another, and an impedance between the two or more shunt lines is higher than an impedance of the transmission line.

According to an embodiment of the invention, there is provided a semiconductor device including the shunt switch according to the above-described embodiment of the invention. According to an embodiment of the invention, there are provided a module and an electronic device each including the semiconductor device according to the embodiment of the invention.

In the shunt switch, the semiconductor device, the module and the electronic device according to the embodiment of the invention, in an ON state (an open operation), the transmission line and the ground are not electrically coupled, and, for example, a high-frequency signal is transmitted in the transmission line. In an OFF state (a close operation), the transmission line is connected to the ground through the shunt line. In this case, two or more of the shunt lines are arranged in parallel to one another, and an impedance between the shunt lines is higher than an impedance of the transmission line, so the generation of a return signal through the shunt lines is reduced, and an impedance of each shunt line is reduced. Therefore, isolation in the OFF state (the close operation) is improved.

In the shunt switch according to the embodiment of the invention, two or more of the shunt lines are arranged in parallel to one another, and the impedance between the shunt lines is higher than the impedance of the transmission line, so isolation is improvable. Therefore, in the semiconductor device, the module and the electronic device each of which includes the shunt switch, an improvement in high-frequency characteristics are achievable.

Other and further objects, features and advantages of the invention will appear more fully from the following description.

BRIEF DESCRIPTION OF THE DRAWINGS

FIGS. 1A and 1B are illustrations of a circuit configuration of a shunt switch according to an embodiment of the invention.

FIGS. 16A and 16B are illustrations for describing functions of the shunt switch illustrated in FIGS. 11A and 11B.

FIGS. 21A and 21B are circuit configuration diagrams of the shunt switch illustrated in FIGS. 20A and 20B.

FIGS. 27A and 27B are illustrations for describing a configuration and functions of a shunt switch according to Modification 4.

DETAILED DESCRIPTION OF THE PREFERRED EMBODIMENTS

Figure 2A:
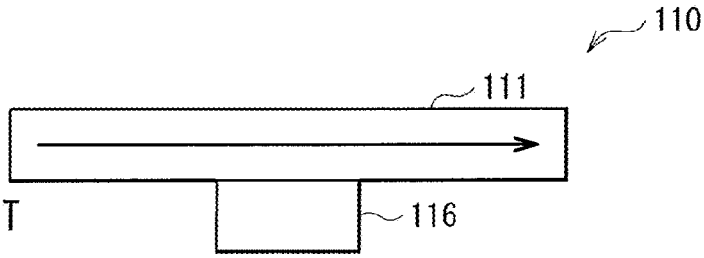
FIG. 2A RELATED ART
FIGS. 2A and 2B are a schematic plan view and a circuit configuration diagram of a shunt switch in related art.

Preferred embodiments will be described in detail below referring to the accompanying drawings.

FIGS. 1A and 1B illustrate a circuit configuration of a shunt switch according to an embodiment of the invention in an ON state (an open operation) and in an OFF state (a close operation), respectively. A shunt switch 10 includes, for example, a transmission line 11, a ground 12, shunt lines 13A, 13B and 13C (hereinafter collectively called shunt lines 13).

The transmission line 11 is a signal line transmitting a signal, for example, a high-frequency signal between an input port Vin and an output port Vout. The shunt lines 13 connect the transmission line 11 to the ground 12 by electrically coupling the transmission line 11 and the ground 12 to each other, and have a sufficiently small impedance Z1, compared to an impedance Z2 of the transmission line 11.

Two or more of the shunt lines 13 (in FIGS. 1A and 1B, three shunt lines 13A to 13C) are arranged in parallel to one another. An impedance Z3 between the two or more shunt lines 13 is higher than the impedance Z2 of the transmission line 11. Thereby, in the shunt switch 10, isolation is improvable.

The configuration of such a shunt switch 10 will be described below in comparison with a shunt switch in related art.

Figure 2B:
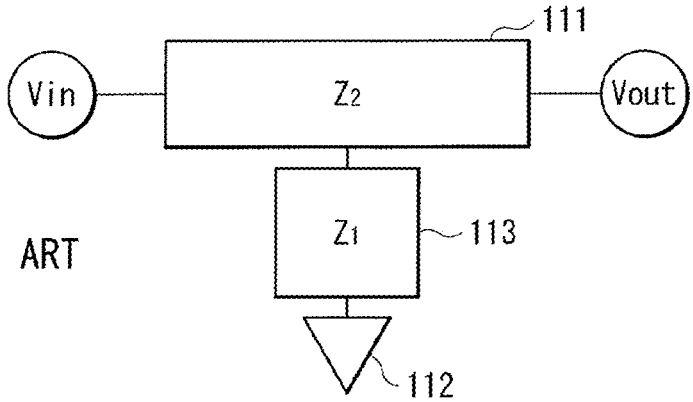
FIG. 2B RELATED ART

FIG. 2B illustrates a circuit configuration of a shunt switch 110 in related art in which only one shunt line 113 is arranged for a transmission line 111, and FIG. 2A illustrates a schematic configuration of the shunt switch 110 corresponding to FIG. 2B. In the shunt switch 110 in related art, as illustrated in FIG. 2A, a moving electrode 116 as the shunt line 113 is brought into contact with the transmission line 111 so that the transmission line 111 is connected to a ground 112.

As described above, the isolation of the shunt switch 110 illustrated in FIG. 2B is defined as 10 Log(Z1/Z2) with use of an impedance Z1 of the shunt line 113 and an impedance Z2 of the transmission line 111, and typically an isolation of −20 dB to −40 dB is necessary. The impedance Z2 of the transmission line 111 has an upper limit so as to keep an insertion loss approximately 1 dB, so in order to improve isolation, it is desirable to reduce only the impedance Z1 of the shunt line.

Figure 3A:
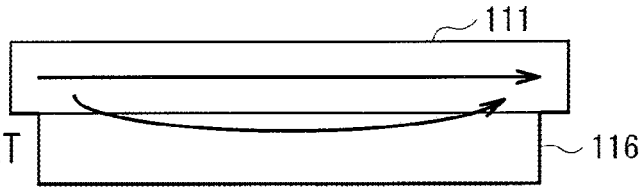
FIG. 3A RELATED ART
FIGS. 3A and 3B are a schematic plan view and a circuit configuration diagram of another shunt switch in related art.
Figure 3B:
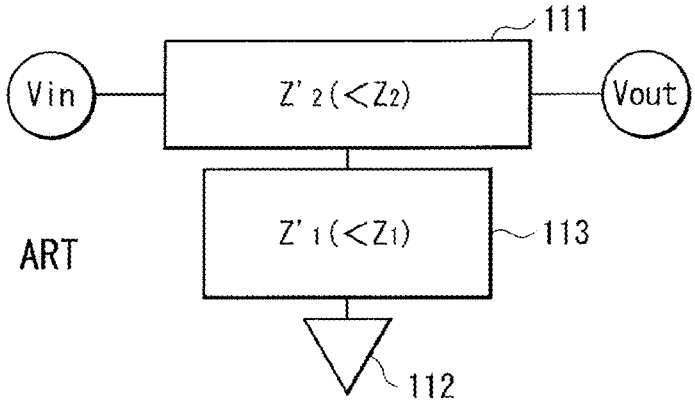
FIG. 3B RELATED ART

As one of methods of reducing the impedance Z1 of the shunt line 113, for example, as illustrated in FIGS. 3A and 3B, it is considered that the dimensions of the moving electrode 116 as the shunt line 113 are increased. When the dimensions of the moving electrode 116 are increased, a contact area between the moving electrode 116 and the transmission line 111 is increased so that an impedance Z'1 of the shunt line 113 is reduced to be lower than the impedance Z1 in FIGS. 2A and 2B (Z'1<Z1). However, in this case, an impedance Z'2 of the transmission line 111 is also reduced (Z'2<Z2), thereby a so-called return signal is easily generated.

Figure 4:
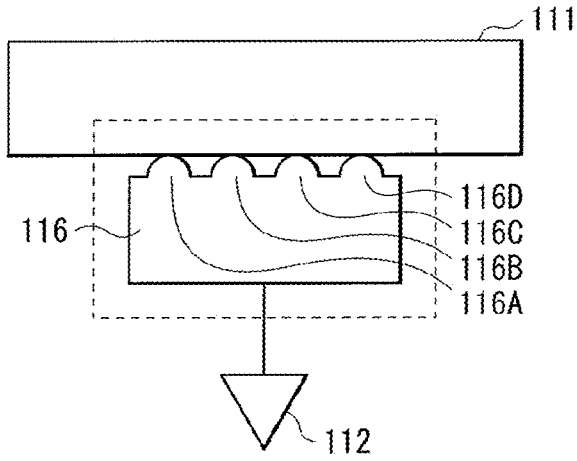
FIG. 4 RELATED ART
FIG. 4 is a schematic plan view of still another shunt switch in related art.

As a method of preventing the return signal, as illustrated in FIG. 4, it is considered that projected contact points 116A, 116B, 116C and 116D are arranged on a surface of the moving electrode 116. Moreover, as illustrated in FIG. 5, incisions may be arranged between the contact points 116A to 116D so as to form the moving electrode 116 in a comb shape.

Figure 5:
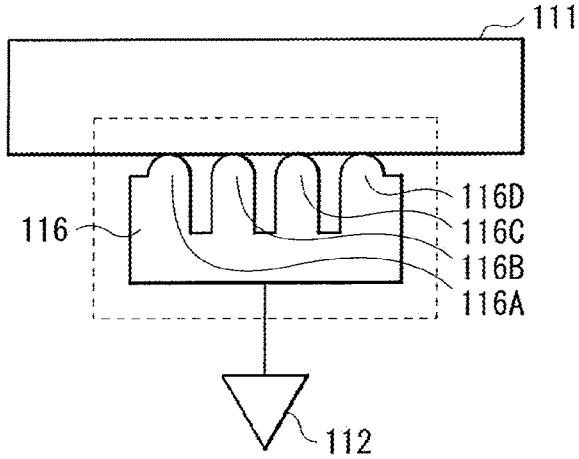
FIG. 5 RELATED ART
FIG. 5 is a plan view illustrating a modification of FIG. 4.
Figure 6:
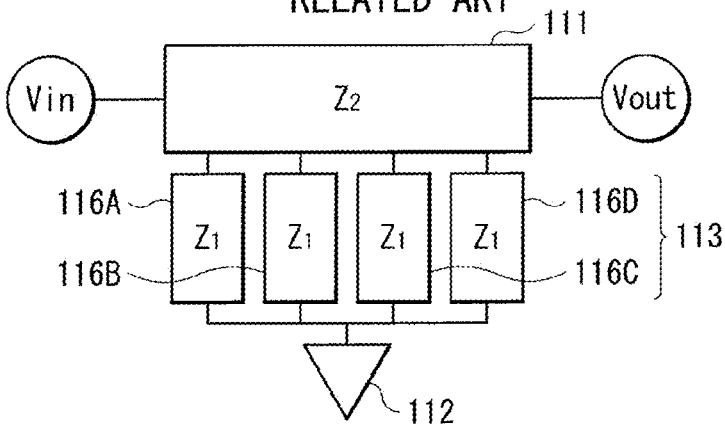
FIG. 6 RELATED ART
FIG. 6 is a circuit configuration diagram of the shunt switch in related art illustrated in FIGS. 4 and 5.

FIG. 6 illustrates a circuit configuration corresponding to FIGS. 4 and 5. In the configurations illustrated in FIGS. 4 and 5, the contact points 116A to 116D are arranged to increase current paths, so a decline in the impedance Z2 of the transmission line 111 is allowed to be reduced, compared to the configuration illustrated in FIGS. 2A and 2B or FIGS. 3A and 3B. However, the contact points 116A to 116D are coupled with a sufficiently low impedance, so it is difficult to prevent the return signal, so isolation is not sufficiently improved.

On the other hand, in the shunt switch 10 according to the embodiment illustrated in FIGS. 1A and 1B, three shunt lines 13A to 13C are insulated from one another with the impedance Z3 which is sufficiently higher than the impedance Z2 of the transmission line 11 (Z3>Z2). Therefore, an impedance Zoff in an OFF state of the shunt switch 10 is an ideal value, that is, one third of the impedance Z1 of the shunt line 113 illustrated in FIGS. 2A and 2B ((Z1)/3), because signals which return to the transmission line 11 through the shunt line 13 are reduced.

In addition, it is obvious that the same applies to the case where in FIGS. 1A and 1B, some or all of the impedances Z1 of the shunt lines 13A to 13C, or some or all of the impedances Z3 between the shunt lines 13A to 13C are different from one another.

Next, functions of the shunt switch 10 will be described below.

In the shunt switch 10, in an ON state (an open operation), as illustrated in FIG. 1A, the transmission line 11 and the ground 12 are not electrically coupled to each other, and a signal entering from the input port Vin passes through the transmission line 11 to be outputted from the output port Vout. On the other hand, in an OFF state (a close operation), as illustrated in FIG. 1B, three shunt lines 13A to 13C are connected to the transmission line 11, and the transmission line 11 is connected to the ground 12 through the shunt lines 13A to 13C.

In this case, two or more shunt lines 13 are arranged in parallel to one another, and each of the impedances Z3 between the shunt lines 13A to 13C is higher than the impedance Z2 of the transmission line 11, so the generation of a return signal having passed through the shunt lines 13A to 13C is reduced, and the impedance Z1 of each of the shunt lines 13A to 13C is reduced. Therefore, isolation in the OFF state (a close operation) is improved without impairing insertion loss characteristics in the ON state (an open operation).

Specific embodiments of the shunt switch 10 having the circuit configuration illustrated in FIGS. 1A and 1B will be described below, and descriptions will be given in the following order.

Figure 7:
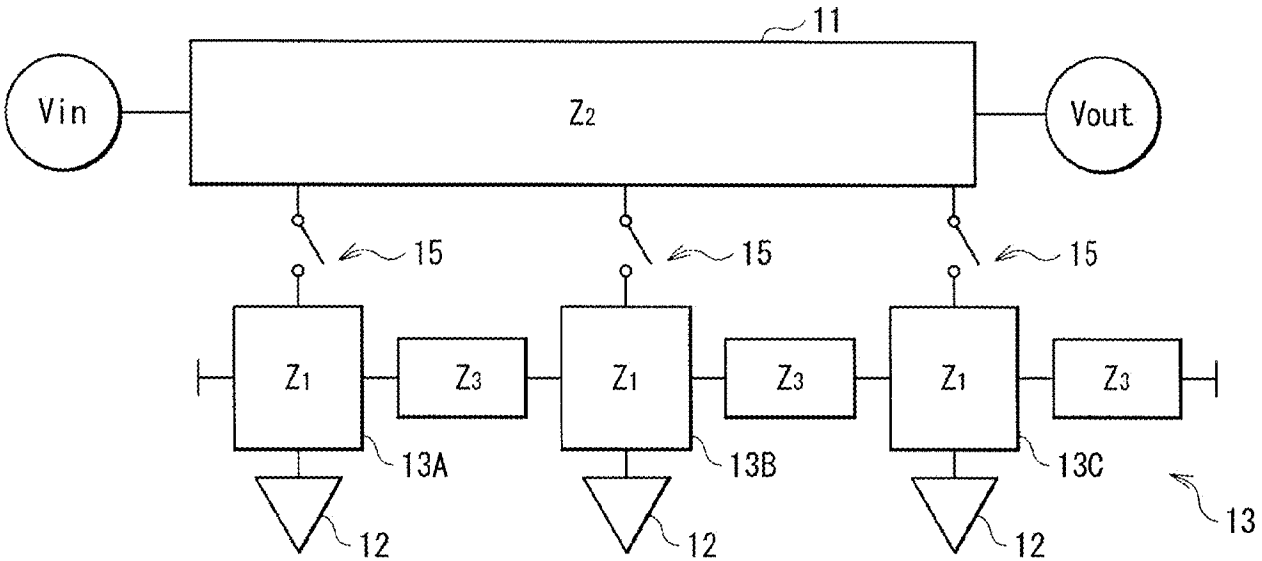
FIG. 7 is an equivalent circuit diagram of the shunt switch illustrated in FIGS. 1A and 1B.

(1) Equivalent circuit
(2) First embodiment (an example in which two shunt lines are arranged in parallel to each other near an input port and an output port, respectively, and perform a horizontal operation)
(3) Modification 1 (an example in which two shunt lines are arranged in parallel to each other near an input port)
(4) Second embodiment (an example in which a projection for contact with a fixed electrode is included in a central part of a transmission line)
(5) Modification 2 (an example in which a fixed electrode includes a projection for contact with a central part of a transmission line)
(6) Modification 3 (an example using a bimetal)
(7) Modification 4 (an example performing a vertical operation)
(8) Application examples Equivalent Circuit FIG. 7 illustrates the ON state and the OFF state of the shunt switch 10 illustrated in FIGS. 1A and 1B as one equivalent circuit. In FIG. 7, a switching system between the ON state and the OFF state of the shunt switch 10 is represented by a switch 15 between the transmission line 11 and each shunt line 13.

FIGS. 8A and 8B to 10A and 10B illustrate configuration examples of the switch 15. The shunt lines 13 each are preferably configured of a moving electrode 16 which is displaceable with respect to one or both of the transmission line 11 and the ground 12. The shunt lines 13 each are configured of the moving electrode 16 as a mechanical part, thereby the shunt lines 13 are allowed to mechanically open or close the switch 15 illustrated in FIG. 7. Therefore, insertion loss and isolation relative to connection between the transmission line 11 and the shunt lines 13 are compatible.

Figure 8A:
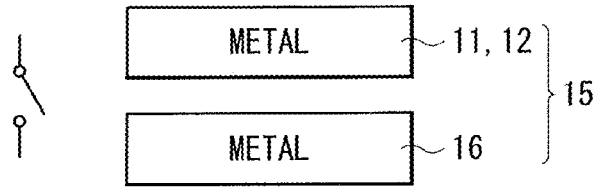
FIGS. 8A and 8B are illustrations of an example of the switch illustrated in FIG. 7.
Figure 8B:
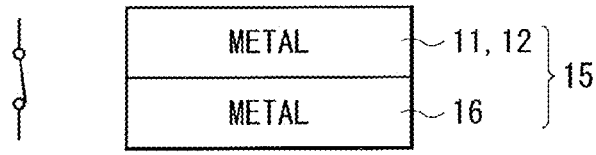
Figure 9A:
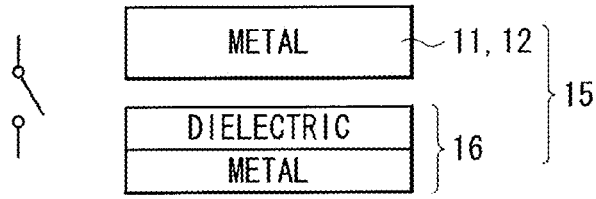
FIGS. 9A and 9B are illustrations of a modification of FIGS. 8A and 8B.
Figure 9B:
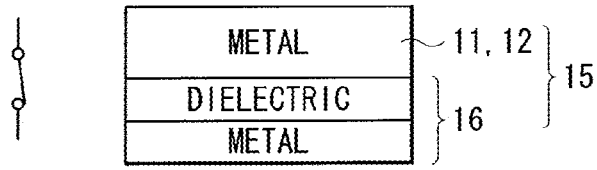
Figure 10A:
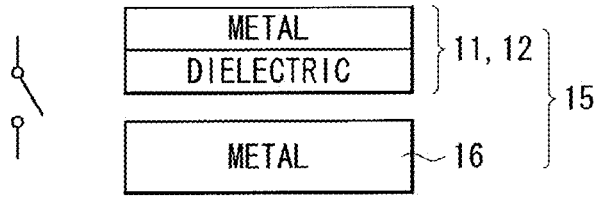
FIGS. 10A and 10B are illustrations of another modification of FIGS. 8A and 8B.
Figure 10B:
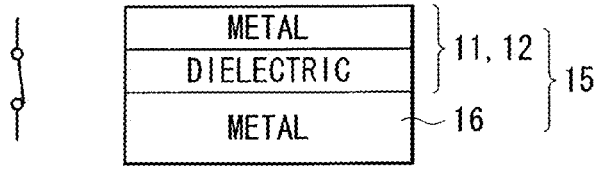

Connection between the moving electrode 16, and the transmission line 11 and the ground 12 may be of a direct contact type in which surfaces of metals as illustrated in FIGS. 8A and 8B are directly opened and closed, or of a capacity change type in which the moving electrode 16, and the transmission line 11 and the ground 12 are connected to each other with a dielectric in between as illustrated in FIGS. 9A and 9B or FIGS. 10A and 10B. As the metals, for example, gold (Au) or an alloy including Au as a base material is preferable. In the case of the capacity change type, as illustrated in FIGS. 9A and 9B, the dielectric may be arranged on a side of the moving electrode 16, or as illustrated in FIGS. 10A and 10B, the dielectric may be arranged on sides of the transmission line 11 and the ground 12. In addition, the moving electrode 16 has a complicated shape in many cases, so the dielectric is preferably arranged on the sides of the transmission line 11 and the ground 12 as illustrated in FIGS. 10A and 10B.

First Embodiment

Figure 11A:
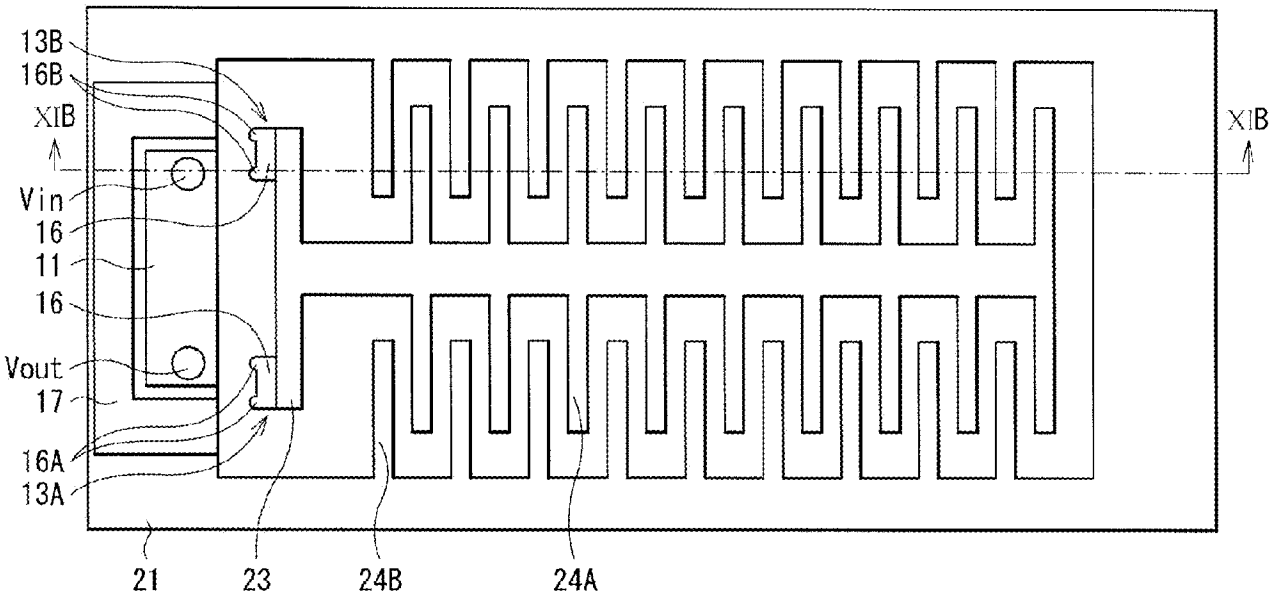
FIGS. 11A and 11B are a plan view and a sectional view illustrating the whole configuration of a shunt switch according to a first embodiment of the invention.
Figure 11B:
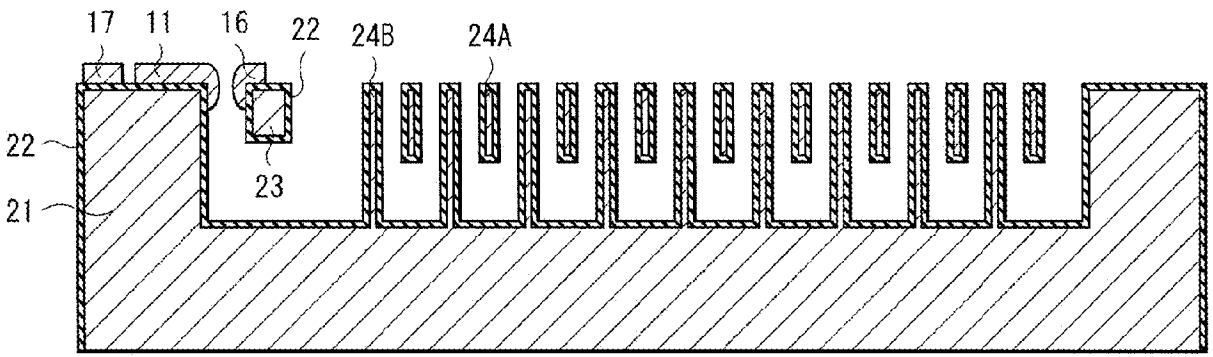

FIG. 11A illustrates the whole configuration of the shunt switch 10 according to a first embodiment of the invention, and FIG. 11B illustrates a sectional configuration taken along an arrow direction XIB-XIB in FIG. 11A. The shunt switch 10 is a micro-structure (a micromachine) mounted to mechanically connect and disconnect the transmission line 11 transmitting a signal, for example, a high-frequency signal from one device (not illustrated) to another device (not illustrated). Moreover, the shunt switch 10 is preferably formed in one package with any other device, and the shunt switch 10 is more preferably packaged and mounted in a SiP (System in Package) or mounted as a part of a SoC. The shunt switch 10 includes, for example, the transmission line 11 and a ground line 17 as the ground 12 on a substrate 21 made of a semiconductor or the like, and includes the moving electrode 16 as the shunt line 13 which faces the transmission line 11 and the ground line 17.

Examples of the substrate 21 include substrates made of Si-based semiconductors such as silicon (Si), silicon carbide (SiC), silicon-germanium (SiGe) and silicon-germanium-carbon (SiGeC). Moreover, as the substrate 21, a non-Si-based substrate made of glass, a resin or plastic may be used. An insulating film 22 made of silicon oxide ($SiO_2$), silicon nitride (SiN) or a laminate film including a SiN film and a $SiO_2$ film is arranged on a surface of the substrate 21, and the substrate 21, the transmission line 11 and the ground line 17 are electrically separated from one another by the insulating film 22.

The transmission line 11 is arranged as a linear fixed electrode on the insulating film 22 on the surface of the substrate 21. The input port Vin and the output port Vout are arranged at one end and the other end of the transmission line 11, respectively.

The ground line 17 is arranged as a fixed electrode which is set to a ground potential on the insulating film 22 on the surface of the substrate 21. The ground line 17 has, for example, a rectangular shape without one side, and is arranged so that three sides of the transmission line 11 are surrounded by the ground line 17.

Two or more moving electrodes 16 are arranged separately from one another on a moving section 23 which is displaceable with respect to the transmission line 11 and the ground line 17. The two or more moving electrodes 16 are insulated from one another by the insulating film 22 arranged on a surface of the moving section 23. Thereby, in the shunt switch 10, as described above referring to FIGS. 1A and 1B, two or more shunt lines 13 are arranged in parallel to one another, and the impedance Z3 between the two or more shunt lines 13 is higher than the impedance Z2 of the transmission line 11, so isolation is improvable.

The moving section 23 is formed as one unit with the substrate 21 by processing the substrate 21 with use of a MEMS technique, and is displaceable in a horizontal direction with respect to the surface of the substrate 21. In other words, the shunt switch 10 is classified into a so-called lateral switch in which the transmission line 11, the ground line 17 and the moving electrode 16 are arranged in one horizontal plane, and the moving electrode 16 on the moving section 23 is displaced in the horizontal direction.

The moving section 23 is linearly arranged in parallel to the transmission line 11, and one moving electrode 16 is arranged at each of both ends of the moving section 23. In other words, two moving electrodes 16 are arranged near the input port Vin and the output port Vout of the transmission line 11, respectively, and are arranged in parallel to each other with respect to a transmission signal passing through the transmission line 11. The two moving electrodes 16 each include projected contact points 16A and 16B corresponding to the transmission line 11 and the ground line 17.

The moving section 23 is coupled to one (for example, a comb electrode 24A) of a pair of comb electrodes 24A and 24B which are engaged with each other, and is displaceable by electrostatic force generated between the pair of comb electrodes 24A and 24B. The comb electrode 24B is fixed to the substrate 21. As in the case of the moving section 23, the comb electrodes 24A and 24B are formed by three-dimensionally processing a material of the substrate 21, for example, silicon (Si) with use of a known lithography technique. An electrode layer (not illustrated) is arranged on facing surfaces of comb-teeth parts of the comb electrodes 24A and 24B. In the comb electrodes 24A and 24B, in an ON operation, electromagnetic force as driving force is generated by voltage application from a power source (not illustrated), thereby the comb electrode 24A is attracted toward the comb electrode 24B, and the moving electrodes 16 are brought into contact with the transmission line 11 and the ground line 17 in synchronization with the comb electrode 24A.

The shunt switch 10 is manufacturable by, for example, the following steps.

FIGS. 12A and 12B to FIGS. 15A and 15B illustrate a method of manufacturing main parts of the shunt switch 10 in order of steps. In addition, FIGS. 12A to 15A illustrate a planar configuration and FIGS. 12B to 15B illustrate a sectional configuration taken along a line B-B of FIGS. 12A to 15A.

Figure 12A:
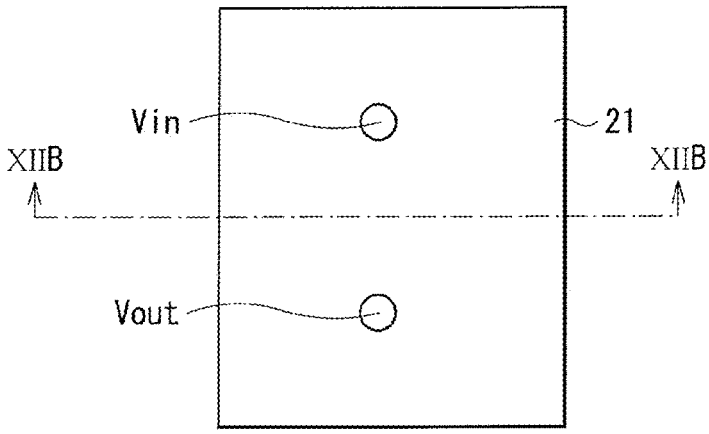
FIGS. 12A and 12B are a plan view and a sectional view illustrating a step in a method of manufacturing the shunt switch illustrated in FIGS. 11A and 11B.
Figure 12B:
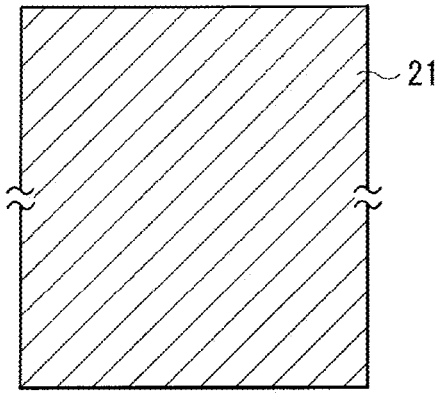

First, as illustrated in FIGS. 12A and 12B, the substrate 21 made of the above-described material, for example, silicon (Si) is prepared, and the substrate 21 is three-dimensionally processed with use of a lithography technique to form vias as the input port Vin and the output port Vout.

Figure 13A:
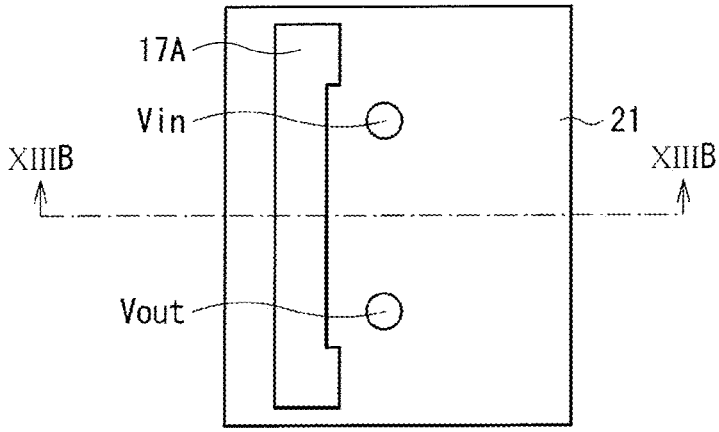
FIGS. 13A and 13B are a plan view and a sectional view illustrating a step following the step of FIGS. 12A and 12B.
Figure 13B:
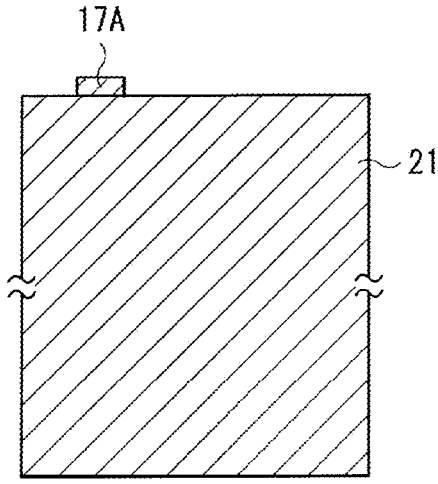

Next, as illustrated in FIGS. 13A and 13B, as a part of the ground line 17, a wire 17A made of, for example, an Al—Cu alloy with a thickness of 0.8 μm is formed.

Figure 14A:
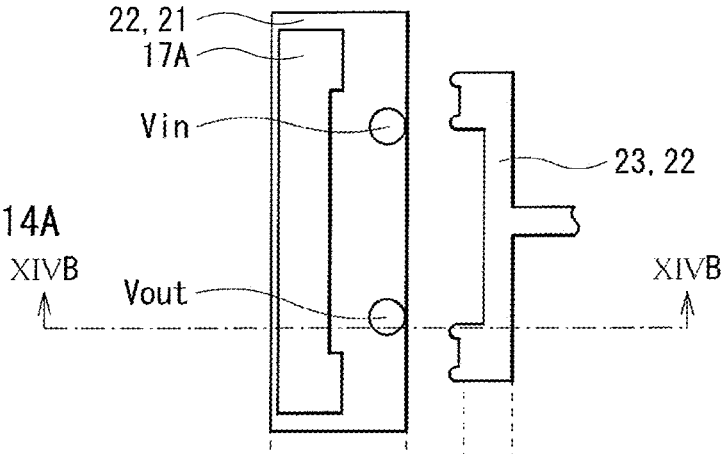
FIGS. 14A and 14B are a plan view and a sectional view illustrating a step following the step of FIGS. 13A and 13B.
Figure 14B:
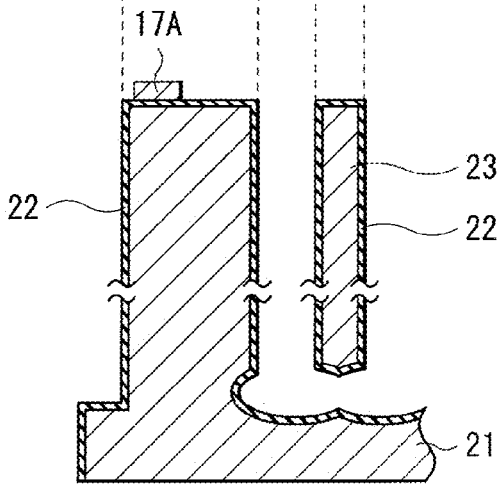

Then, as illustrated in FIGS. 14A and 14B, the substrate 21 is vertically processed (deep etching of silicon) by RIE (Reactive Ion Etching) with use of, for example, a MEMS technique to form the moving section 23. At the same time, the comb electrodes 24A and 24B are also formed.

After the moving section 23 and the comb electrodes 24A and 24B are formed, the insulating film 22 made of the above-described material is formed on the surface of the substrate 21 by, for example, a CVD (Chemical Vapor Deposition) method or a PVD (Physical Vapor Deposition) method.

Figure 15A:
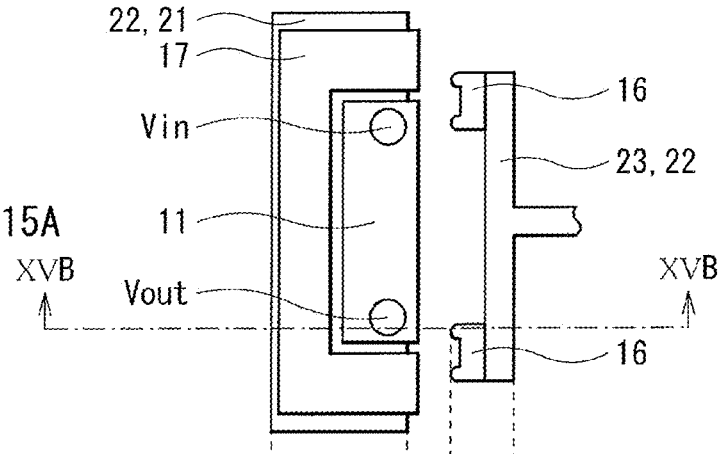
FIGS. 15A and 15B are a plan view and a sectional view illustrating a step following the step of FIGS. 14A and 14B.
Figure 15B:
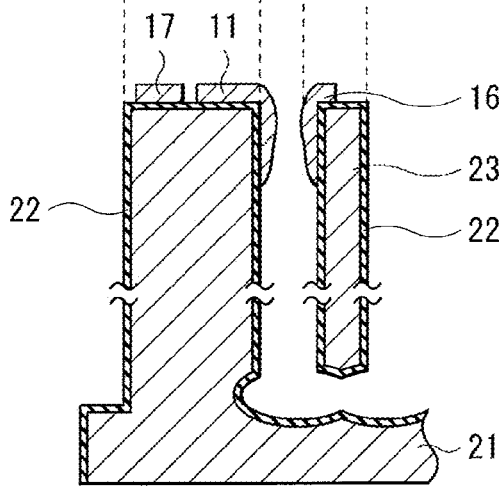

After that, as illustrated in FIGS. 15A and 15B, the transmission line 11 and the remaining part of the ground line 17 are formed on the substrate 21, and the moving electrodes 16 are formed at both ends of the moving section 23. At this time, electrodes (not illustrated) for voltage application are formed on surfaces of the comb electrodes 24A and 24B at the same time. The moving electrodes 16 may have, for example, a configuration in which a titanium (Ti) film with a thickness of 0.1 μm and a gold (Au) film with a thickness of 2 μm are laminated in order from the substrate 21. Thus, the shunt switch 10 illustrated in FIGS. 11A and 11B is completed.

In the shunt switch 10, in the open operation (the ON state) illustrated in FIGS. 11A and 11B and FIG. 16A, a command for the close operation (the OFF state) is received, a predetermined voltage is applied to the comb electrodes 24A and 24B to generate electromagnetic force between the comb electrodes 24A and 24B. As a result, the comb electrode 24A comes close to the comb electrode 24B, and the moving section 23 moves in a horizontal direction toward the transmission line 11 in synchronization with the comb electrode 24A so that as illustrated in FIG. 16B, the moving electrode 16 is brought into contact with the transmission line 11 and the ground line 17. Thereby, the transmission line 11 turns to a close state (the OFF state).

After the close operation (the OFF state), when a command for the open operation (the ON state) is received, electromagnetic force between the comb electrodes 24A and 24B is released, and the moving electrodes 16 are separated from the transmission line 11 and the ground line 17 accordingly to return to positions in FIGS. 11A and 11B and FIG. 16A.

Figure 17B:
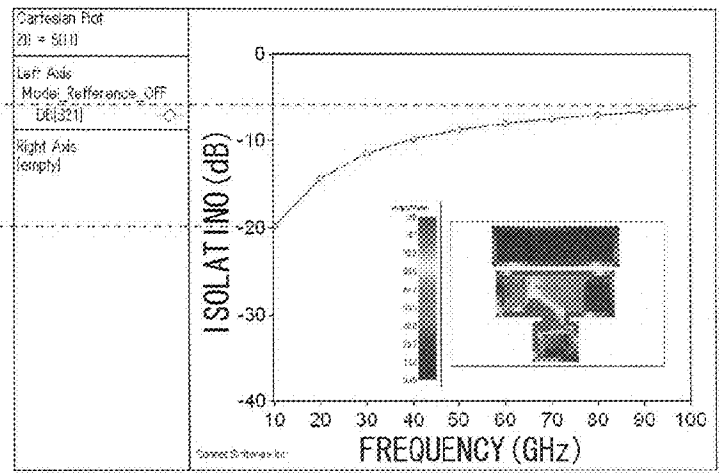
FIG. 17 is an illustration of isolation characteristics of the shunt switch illustrated in FIGS. 11A and 11B in comparison with related art.
Figure 17A:
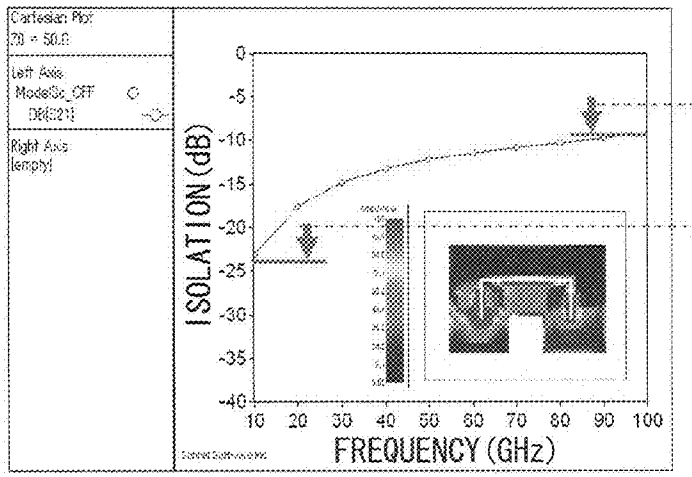

FIG. 17 illustrates calculation results of high-frequency characteristics (isolation characteristics) by an electromagnetic field analysis of the shunt switch 10 in comparison with that in the configuration in related art described in FIGS. 2A and 2B. It was obvious from FIG. 17 that in the shunt switch 10, isolation was higher by 3 dB than that in the configuration in related art, and the isolation reached an evaluation standard value (10 dB at 60 GHz) set in the electromagnetic field analysis.

Thus, in the embodiment, two or more moving electrodes 16 are arranged separately from one another on the moving section 23 which is displaceable with respect to the transmission line 11 and the ground line 17, and the two or more moving electrodes 16 are insulated from one another by the insulating film 22 arranged on the surface of the moving section 23, so isolation is improvable.

Next, modifications and other embodiments will be described below. In addition, like components are denoted by like numerals as of the first embodiment, and will not be further described.

Modification 1

Figure 18:
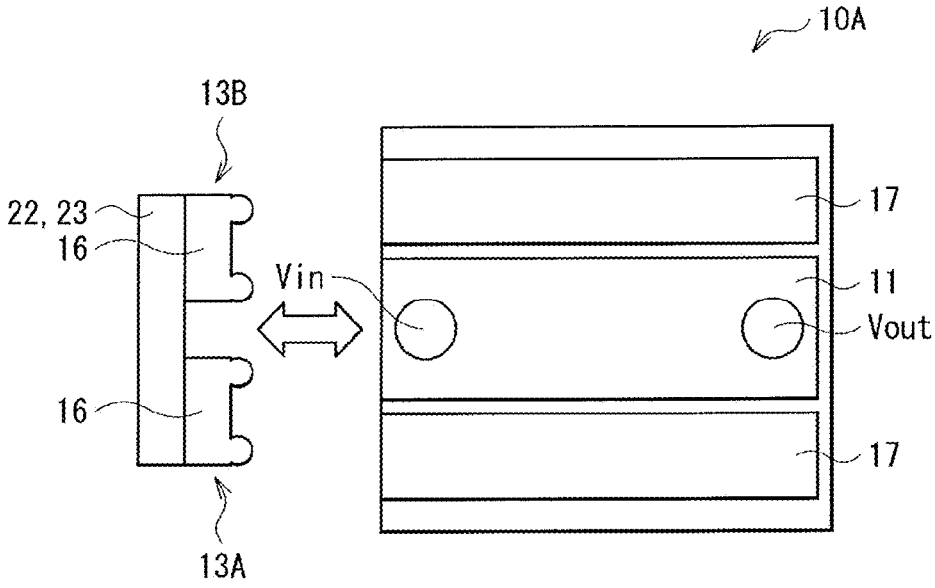
FIG. 18 is a plan view of a shunt switch according to Modification 1.

FIG. 18 illustrates a planar configuration of a shunt switch 10A according to Modification 1. In Modification 1, linear ground lines 17 are arranged on both sides of the transmission line 11, and two moving electrodes 16 are arranged near the input port Vin of the transmission line 11. In other words, in Modification 1, two moving electrodes 16 are arranged in parallel to each other and perpendicular to a transmission signal passing through the transmission line 11. Except for this, the shunt switch 10A is manufacturable in the same manner as that in the shunt switch 10 according to the first embodiment, and the functions and effects of the shunt switch 10A are the same as those of the shunt switch 10.

Figure 19B:
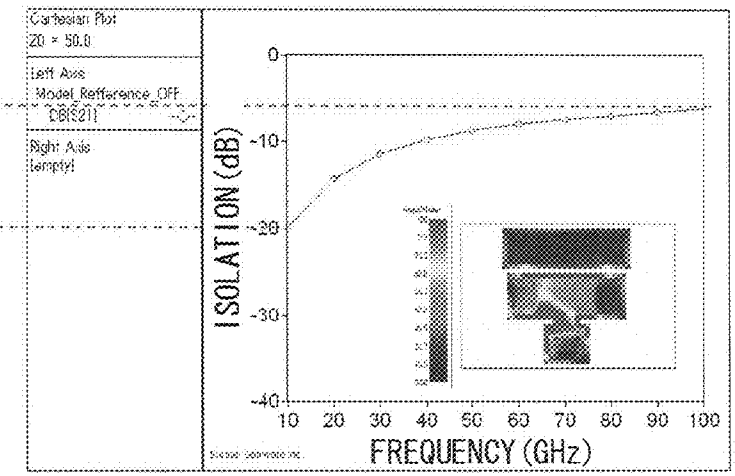
FIG. 19 is an illustration of isolation characteristics of the shunt switch illustrated in FIG. 18 in comparison with related art.
Figure 19A:
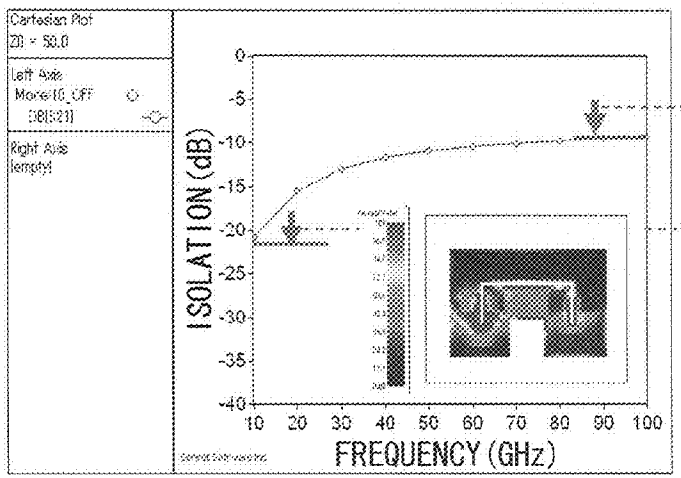

FIG. 19 illustrates calculation results of high-frequency characteristics (isolation characteristics) by an electromagnetic field analysis of the shunt switch 10A according to Modification 1 in comparison with the configuration in related art described in FIGS. 2A and 2B. It was obvious from FIG. 19 that in the shunt switch 10A, isolation was higher by 3 dB than that in the configuration in related art, and reached an evaluation standard value (10 dB at 60 GHz) set in the electromagnetic field analysis.

Second Embodiment

Figure 20A:
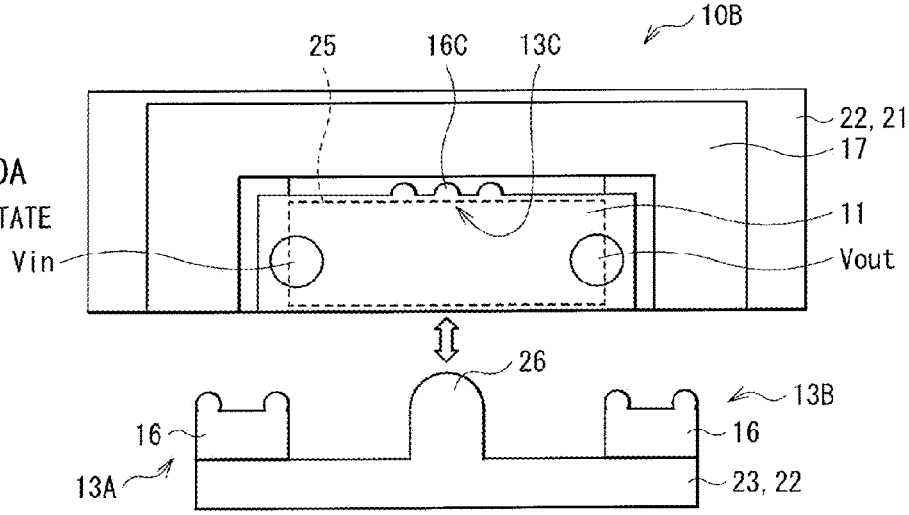
FIGS. 20A and 20B are illustrations for describing a configuration and functions of a shunt switch according to a second embodiment.
Figure 20B:
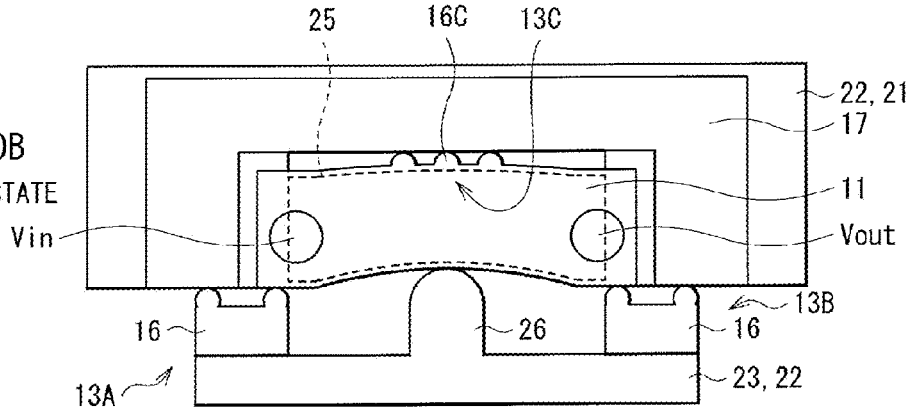

FIGS. 20A and 20B illustrate a planar configuration of a shunt switch 10B according to a second embodiment of the invention. In the embodiment, the transmission line 11 is arranged on a leaf spring 25 formed as one unit with the substrate 21 by processing the substrate 21, and deformation of the leaf spring 25 allows a central part of the transmission line 11 to come in contact with the ground line 17 in the OFF state. In other words, in addition to two moving electrodes 16 (a first shunt line 13A and a second shunt line 13B) arranged on the moving section 23, the shunt switch 10B includes a third shunt line 13C on the central part of the transmission line 11. Except for this, the shunt switch 10B has the same configuration as that of the shunt switch 10 described in the first embodiment, and is manufacturable in the same manner as that in the shunt switch 10.

The moving section 23 includes a pushing projection 26 facing the central part of the transmission line 11. The pushing projection 26 is brought into contact with the leaf spring 25 in response to displacement of the moving section 23 so as to deform the leaf spring 25, thereby the central part of the transmission line 11 is brought into contact with the ground line 17. The transmission line 11 preferably includes a contact projection 16C in a contact position between the transmission line 11 and the ground line 17, because the transmission line 11 and the ground line 17 are allowed to make contact with each other more firmly.

The pushing projection 26 is more preferably projected more toward the transmission line 11 than the moving electrodes 16. Thereby, the leaf spring 25 is pressed, and a side opposite to a side facing the pushing projection 26 of the leaf spring 25, that is, the central part of the transmission line 11 is allowed to be brought into contact with the ground line 17.

FIGS. 21A and 21B illustrate a circuit configuration of the shunt switch 10B in an ON state (an open operation) and in an OFF state (a close operation), respectively. An impedance Z4 of the third shunt line 13C arranged on the central part of the transmission line 11 is sufficiently small with respect to the impedance Z2 of the transmission line 11. Magnitude relation between the impedance Z4 of the third shunt line 13C and the impedances Z1 of the first and second shunt lines 13A and 13B is not specifically limited.

As in the case of the first embodiment, the impedance Z3 between the first and second shunt lines 13A and 13B is higher than the impedance Z2 of the transmission line 11. Moreover, an impedance Z5 between the third shunt line 13C and each of the first and second shunt lines 13A and 13B is higher than the impedance Z2 of the transmission line 11. Thereby, in the shunt switch 10B, isolation is improvable.

In the shunt switch 10B, in the case of the open operation (the ON state) illustrated in FIG. 20A, the moving electrodes 16 are separated from the transmission line 11 and the ground line 17, and the central part of the transmission line 11 is separated from the ground line 17. Therefore, as illustrated in FIG. 21A, the transmission line 11 and the ground 12 are not electrically coupled to each other, and a signal entering from the input port Vin passes through the transmission line 11 to be outputted from the output port Vout.

In the open operation (the ON state), when a command for the close operation (the OFF state) is received, a predetermined voltage is applied to the comb electrodes 24A and 24B (not illustrated in FIGS. 20A and 20B, refer to FIGS. 11A and 11B), and electromagnetic force is generated between the comb electrodes 24A and 24B. As a result, the comb electrode 24A comes close to the comb electrode 24B, and the moving section 23 moves in a horizontal direction toward the transmission line 11 in synchronization with the comb electrode 24A, and as illustrated in FIG. 20B, the moving electrodes 16 (the first and second shunt lines 13A and 13B) are brought into contact with the transmission line 11 and the ground line 17.

At this time, the pushing projection 26 arranged on the moving section 23 is brought into contact with the leaf spring 25 in response to displacement of the moving section 23 so as to bend and deform the leaf spring 25, thereby the central part (the third shunt line 13C) of the transmission line 11 is brought into contact with the ground line 17.

Thereby, as illustrated in FIG. 21B, the first to third shunt lines 13A to 13C are connected to the transmission line 11, and the transmission line 11 turns to a state (the OFF state) where the transmission line 11 is connected to the ground 12 through the first to third shunt lines 13A to 13C.

In this case, the impedance Z3 between the first and second shunt lines 13A and 13B is higher than the impedance Z2 of the transmission line 11. Moreover, the impedance Z5 between the third shunt line 13C and each of the first and second shunt lines 13A and 13B is higher than the impedance Z2 of the transmission line 11. Therefore, generation of a return signal passing through the first to third shunt lines 13A to 13C is reduced, and the impedances Z1 and Z4 of the shunt lines 13A to 13C are reduced. Therefore, isolation in the OFF state (the close operation) is improvable without impairing insertion loss characteristics in the ON state (the open operation).

Moreover, as illustrated in FIGS. 20A and 20B, the third shunt line 13C are physically widely separated from the first and second shunt lines 13A and 13B. Therefore, as the impedance Z5 between the third shunt line 13C and each of the first and second shunt lines 13A and 13B, a larger resistance than the impedance Z3 between the first and second shunt lines 13A and 13B is secured (Z5>Z3). Therefore, in the third shunt line 13C, the return of signals is further reduced, so higher isolation characteristics are obtained.

After the close operation (the OFF state), when a command for the open operation (the ON state) is received, electromagnetic force between the comb electrodes 24A and 24B is released, and accordingly, the moving electrodes 16 are separated from the transmission line 11 and the ground line 17, and the central part of the transmission line 11 is separated from the ground line 17 to return to a position in FIG. 20A.

Figure 22B:
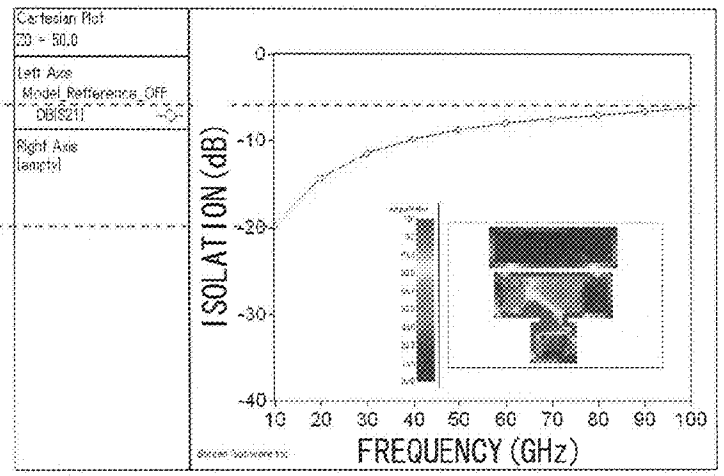
FIG. 22 is an illustration of isolation characteristics of the shunt switch illustrated in FIGS. 20A and 20B in comparison with related art.
Figure 22A:
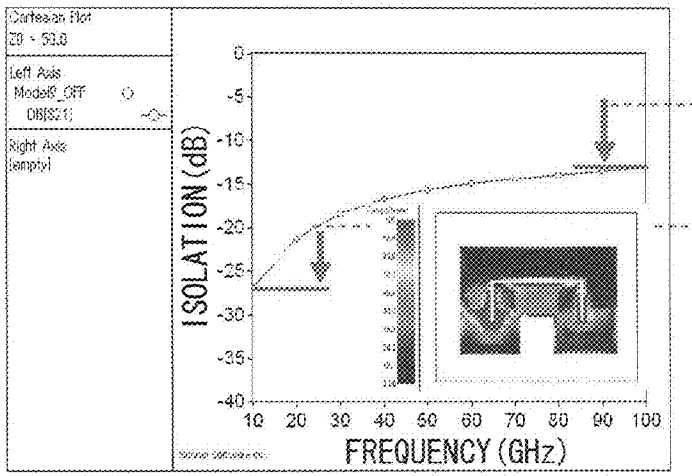

FIG. 22 illustrates calculation results of high-frequency characteristics (isolation characteristics) by an electromagnetic field analysis of the shunt switch 10B according to the embodiment in comparison with the configuration in related art described in FIGS. 2A and 2B. It was obvious from FIG. 22 that in the shunt switch 10B, isolation was higher by 5 dB than that in the configuration in related art, and reached an evaluation standard value (10 dB at 60 GHz) set in the electromagnetic field analysis.

Moreover, in the first embodiment, it was obvious from a part A in FIG. 17 that a part with high current density was observed in the central part of the transmission line 11, but in the embodiment, it was obvious from a part A in FIG. 22 that concentration of current in the central part of the transmission line 11 was released.

Modification 2

Figure 23:
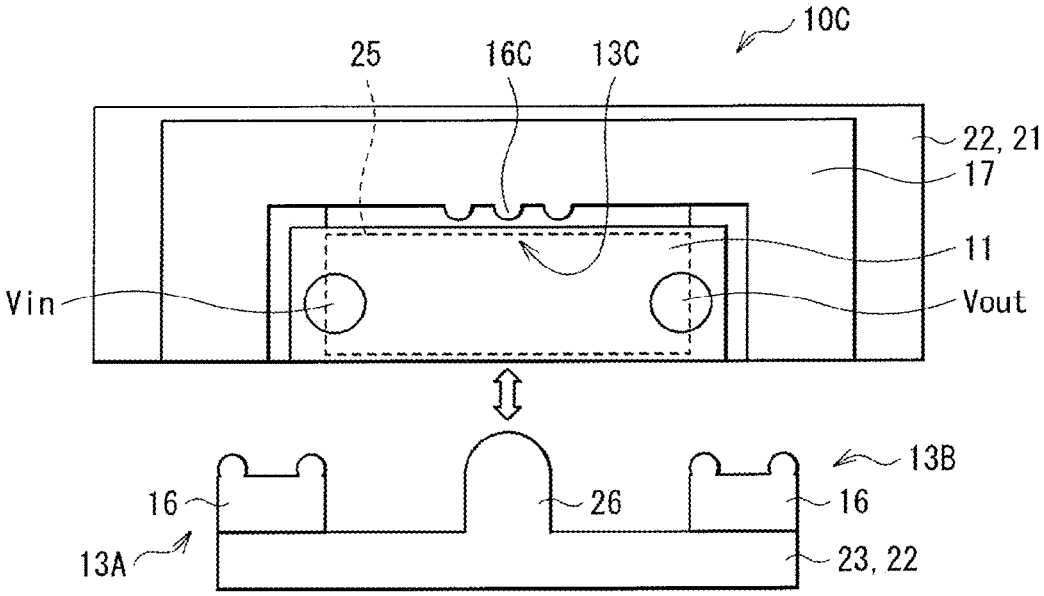
FIG. 23 is a plan view of a shunt switch according to Modification 2.

FIG. 23 illustrates a planar configuration of a shunt switch 10C according to Modification 2. Modification 2 has the same configuration as that of the second embodiment, except that a contact projection 16C is arranged on the ground line 17. Moreover, the shunt switch 10C is manufacturable in the same manner as that in the second embodiment, and the functions and effects of the shunt switch 10C is the same as those in the second embodiment.

Modification 3

Figure 24A:
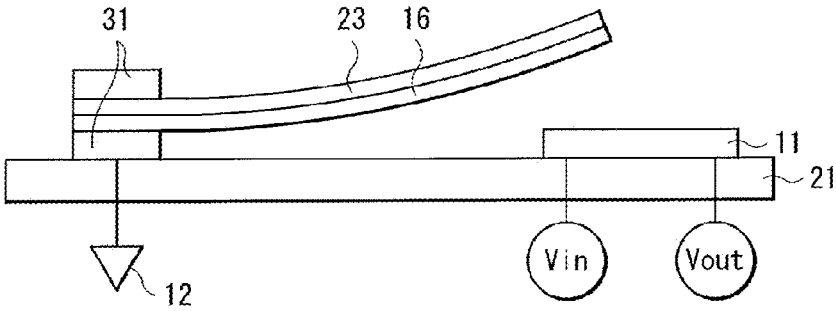
FIGS. 24A and 24B are illustrations for describing a configuration of a shunt switch according to a modification 3.
Figure 24B:
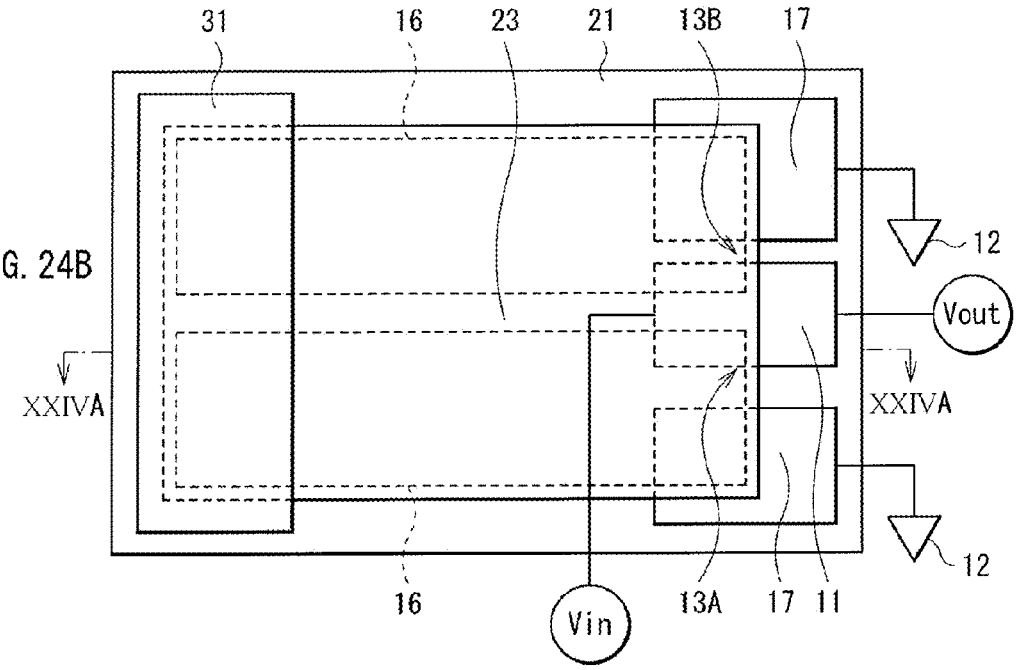

FIGS. 24A and 24B illustrate a configuration of a shunt switch 10D according to Modification 3. In Modification 3, the moving electrodes 16 and the moving section 23 as the shunt line 13 form a bimetal, so the moving electrodes 16 are displaceable with respect to the transmission line 11 and/or the ground line 17 by deforming the moving electrodes 16. In this case, the bimetal is a structure in which a thin piece of two kinds with different expansion coefficients by temperature are bonded together.

Two or more (in FIGS. 24A and 24B, for example, two) moving electrodes 16 are arranged separately from one another on a back surface (a surface facing the substrate 21) of the moving section 23 with a plate shape made of a low-expansion material. When the moving electrodes 16 forms the bimetal in such a manner, the moving electrodes 16 are allowed to have functions of the shunt line 13 with use of expansion and contraction or bending of the moving electrodes 16.

The moving electrodes 16 also have a function as a high-refractive index material layer in the bimetal, and is preferably made of, for example, aluminum (Al), copper (Cu) or gold (Au), or an alloy including them as a base material, because processing is performed at low cost, and these materials are suitable for mass production.

The moving section 23 has a function as a low-expansion material layer in the bimetal, and one end of the moving section 23 is a fixed end fixed to the substrate 21 by a supporting section 31, and the other end of the moving section 23 is a moving end which is allowed to expand and contract or bend in a vertical direction by the bimetal. The moving section 23 is made of, for example, silicon (Si), polycrystalline silicon (polysilicon), a resin material such as polyimide or BCB (benzocyclobutene), or a dielectric film such as SiN or SiO2. The supporting section 31 is made of silicon, polycrystalline silicon or the like, and is grounded.

These two or more moving electrodes 16 are insulated from one another, for example, by forming the moving section 23 of an insulating material or by arranging an insulating film (not illustrated) on a surface of the moving section 23. Thereby, in the shunt switch 10D, as described referring to FIGS. 1A and 1B in the first embodiment, two or more shunt lines 13 are arranged in parallel to one another, and the impedance Z3 between the two or more shunt lines is higher than the impedance Z2 of the transmission line 11, so isolation is improvable.

The transmission line 11 and two ground lines 17 are arranged on the substrate 21 to face the moving end of the moving section 23. The two ground lines 17 are arranged on both sides of the transmission line 11, respectively. One of the moving electrodes 16 faces the transmission line 11 and one of the two ground lines 17. The other moving electrode 16 faces the transmission line 11 and the other one of the two ground lines 17.

Figure 25A:
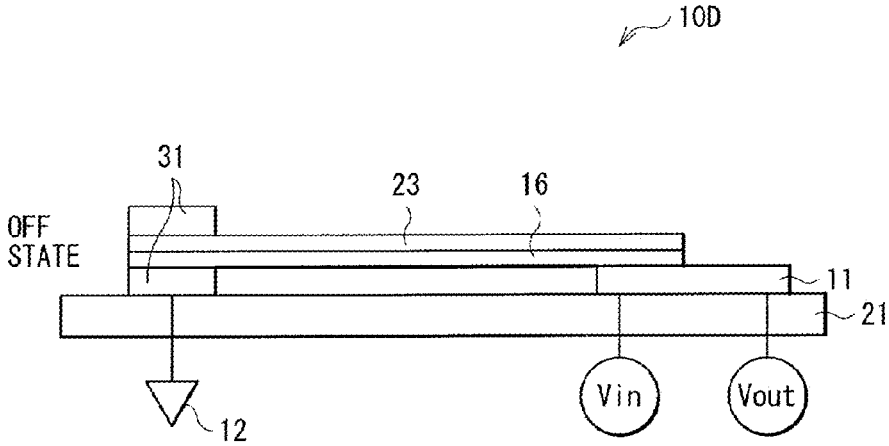
FIGS. 25A and 25B are illustrations for describing functions of the shunt switch illustrated in FIGS. 24A and 24B.
Figure 25B:
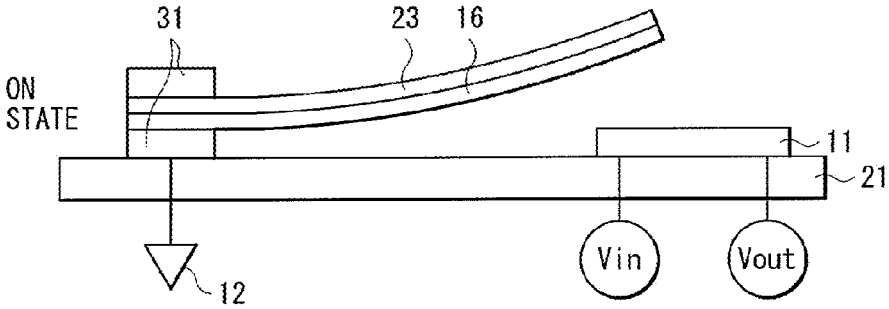

In the shunt switch 10D, at room temperature, the moving section 23 and the moving electrode 16 forming the bimetal are in a straight state as illustrated in FIG. 25A, and the transmission line 11 turns to an OFF state where the transmission line 11 is connected to the ground 12 by the moving electrodes 16. On the other hand, when a temperature is added to the moving section 23 and the moving electrodes 16 forming the bimetal, the moving electrodes 16 made of the high-expansion material have a larger expansion amount than that of the moving section 23 made of the low-expansion material, so the moving section 23 and the moving electrodes 16 bend as illustrated in FIG. 25B, and the transmission line 11 turns to an ON state where the transmission line 11 is separated from the ground 12.

In addition, this modification is applicable to the case where the moving electrodes 16 are deformed by not only heat drive such as bimetal but also piezoelectric drive, electrostatic drive and electromagnetic drive.

Figure 26A:
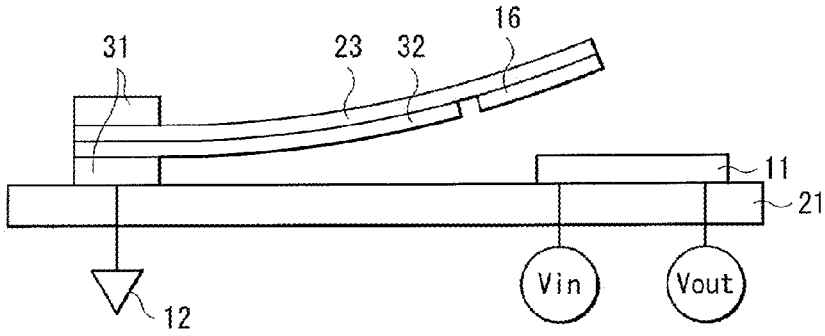
FIGS. 26A and 26B are illustrations of a modification of the shunt switch illustrated in FIGS. 24A and 24B.
Figure 26B:
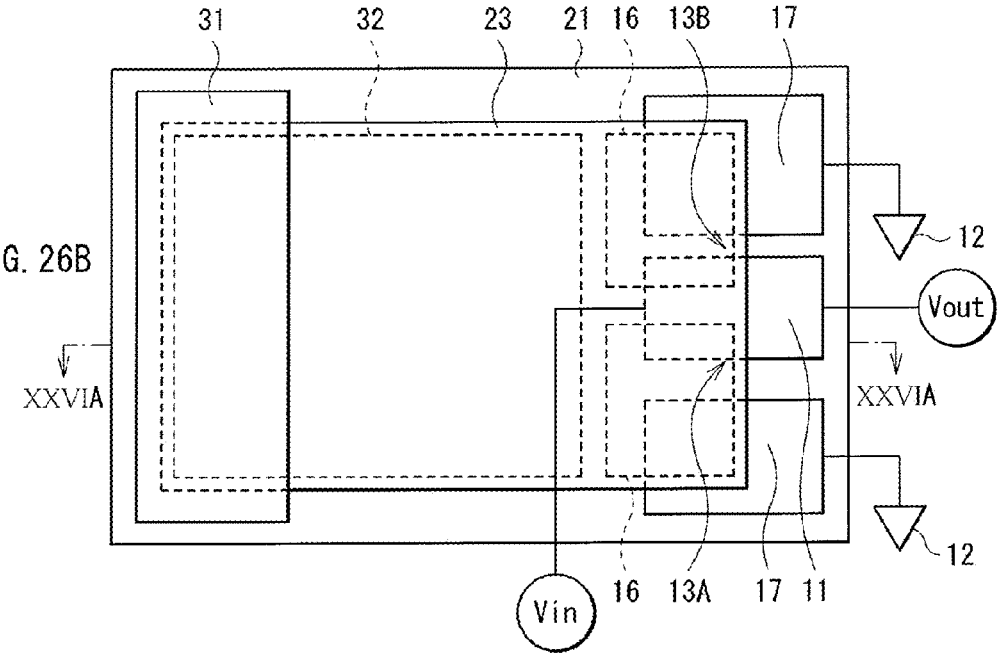

Moreover, as illustrated in FIGS. 26A and 26B, in addition to two moving electrodes 16, a bimetal-drive electrode 23 for bimetal-driving the moving section 23 may be arranged on a back surface of the moving section 23. The bimetal-drive electrode 23 preferably has larger dimensions than the moving electrode 16. When the moving electrodes 16 and the bimetal-drive electrode 32 are separated from each other in such a manner, signal leakage between drive circuits or noise contamination is reduced, and higher isolation characteristics are obtainable.

Modification 4

FIGS. 27A and 27B illustrate a sectional configuration of a shunt switch 10E according to Modification 4 of the invention. In Modification 4, the moving section 23 is coupled to an electrostatic drive moving electrode 28 with a flat spring 27 in between, and the ground line 17 has a function as a fixed electrode for electrostatic drive. The moving section 23 is displaceable in a vertical direction with respect to a surface of the substrate 21 by electrostatic force generated between the electrostatic drive moving electrode 28 and the ground line 17. In addition, the moving electrodes 16 on the moving section 23 are insulated from a control potential of the electrostatic drive moving electrode 28.

In the shunt switch 10E, in an open operation (an ON state) illustrated in FIG. 27B, when a command for a close operation (an OFF state) is received, a predetermined voltage is applied to the electrostatic drive moving electrode 28 and the ground line 17 so as to generate electromagnetic force between the electrostatic drive moving electrode 28 and the ground line 17. As a result, the electrostatic drive moving electrode 28 comes close to the ground line 17. Accordingly, the moving section 23 coupled to the electrostatic drive moving electrode 28 with the flat spring 27 in between moves downward in a vertical direction toward the transmission line 11, and as illustrated in FIG. 27A, the moving electrodes 16 are brought into contact with the transmission line 11 and the ground line 17. Thereby, the transmission line 11 turns to a close state (the OFF state).

After the close operation (the OFF state), when a command for the open operation (the ON state) is received, electromagnetic force between the electrostatic drive moving electrode 28 and the ground line 17 is released, and the moving electrodes 16 are separated from the transmission line 11 and the ground line 17 accordingly to return to positions in FIG. 27B. In addition, in FIGS. 27A and 27B, a signal is transmitted in a direction perpendicular to a paper plane.

In addition, the modification is applicable to not only the above-described electrostatic actuator but also any other drive system using an actuator by a so-called MEMS function such as a piezo actuator, an electromagnetic actuator or a bimetal actuator.

Application Examples

Figure 28:
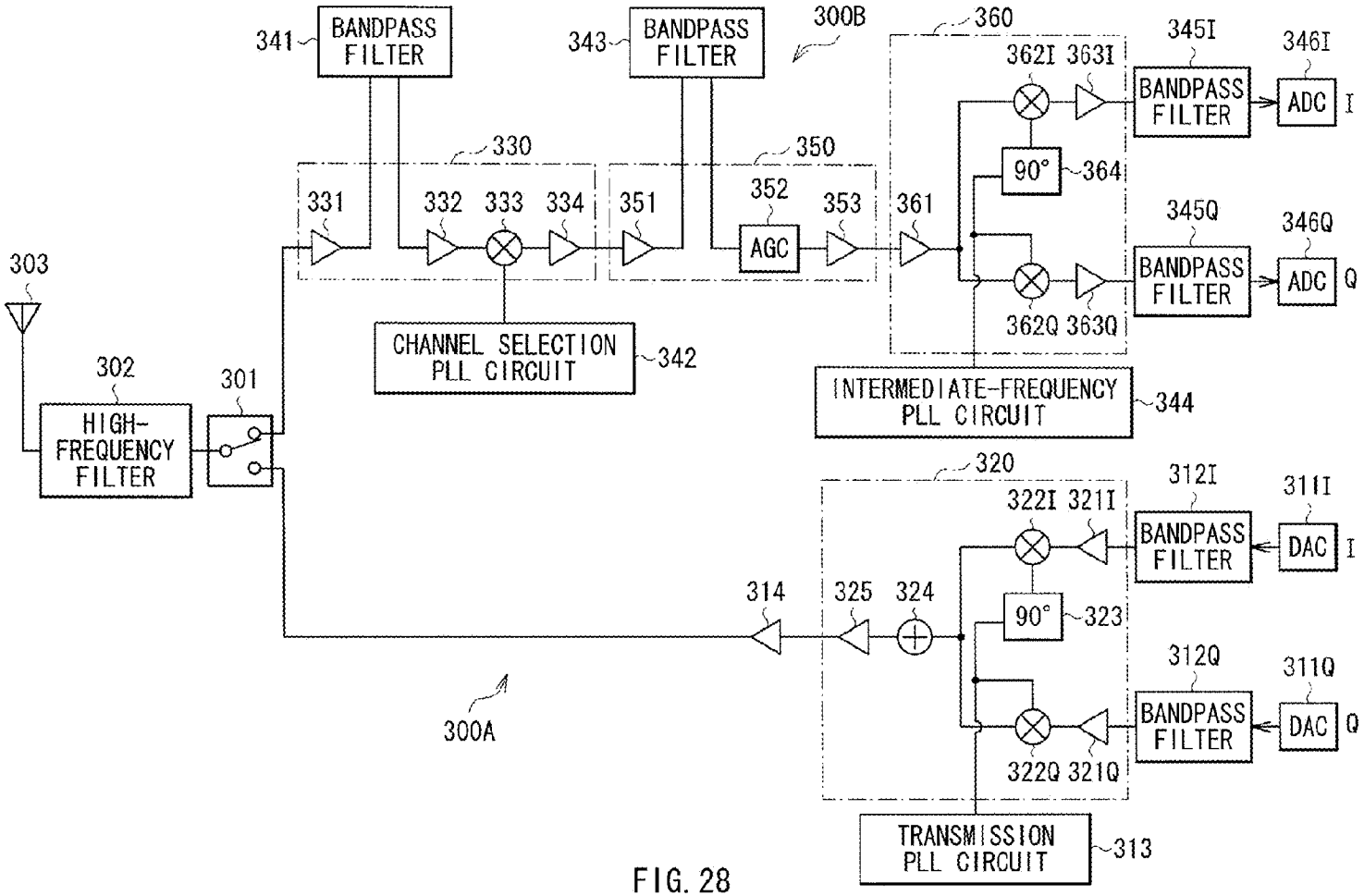
FIG. 28 is a functional block diagram of an electronic device according to an application example of a shunt switch.

Next, referring to FIG. 28, a configuration of a communication device including the shunt switch according to the above-described respective embodiment of the invention will be described below. FIG. 28 illustrates a block diagram of the communication device as an electronic device. In addition, a semiconductor device and a module each of which includes the shunt switch according to the above-described respective embodiment of the invention is embodied by the above-described communication device, and will be also described below.

In the communication device illustrated in FIG. 28, the shunt switch described in the above-described respective embodiment is mounted as a transmit/receive switching device 301 (a semiconductor device), and the communication device is, for example, a cellular phone, a personal digital assistant (PDA), a wireless LAN device or the like. In addition, the above-described transmit/receive switching device 301 is formed in a semiconductor device configured of a SoC. For example, as illustrated in FIG. 28, the communication device includes a transmission circuit 300A (a module), a reception circuit 300B (a module), the transmit-receive switching device 301 switching a transmission/reception path, a high-frequency filter 302 and a transmission/reception antenna 303.

The transmission circuit 300A includes two digital/analogue converters (DAC) 311I and 311Q and two bandpass filters 312I and 312Q corresponding to I-channel transmission data and Q-channel transmission data, respectively, a modulator 320 and a transmission PLL (Phase-Locked Loop) circuit 313, and a power amplifier 314. The modulator 320 includes two buffer amplifiers 321I and 321Q and two mixers 322I and 322Q corresponding to the above-described two bandpass filters 312I and 312Q, respectively, a phase shifter 323, an adder 324 and a buffer amplifier 325.

The reception circuit 300B includes a high-frequency section 330, a bandpass filter 341 and a channel selection PLL circuit 342, an intermediate-frequency circuit 350 and a bandpass filter 343, a demodulator 360 and an intermediate-frequency PLL circuit 344, and two bandpass filters 345I and 345Q and two analogue/digital converters (ADCs) 346I and 346Q corresponding to I-channel reception data and Q-channel reception data, respectively. The high-frequency section 330 includes a low-noise amplifier 331, buffer amplifiers 332 and 334 and a mixer 333, and the intermediate-frequency circuit 350 includes buffer amplifiers 351 and 353 and an auto gain controller (AGC) circuit 352. The demodulator 360 includes a buffer amplifier 361, two mixers 362I and 362Q and two buffer amplifiers 363I and 363Q corresponding to the above-described two bandpass filters 345I and 345Q, respectively, and a phase shifter 364.

In the communication device, when I-channel transmission data and Q-channel transmission data are inputted into the transmission circuit 300A, the transmission data are processed in the following order. First, the transmission data are converted into analog signals in the DAC 311I and 311Q, and signal components except for frequency bands of transmission signals are removed from the analog signals in the bandpass filters 312I and 312Q, and then the analog signals are supplied to the modulator 320. Next, in the modulator 320, the analog signals are supplied to the mixers 322I and 322Q through the buffer amplifiers 321I and 321Q, and are modulated by mixing the analog signals with a frequency signal corresponding to a transmission frequency supplied from transmission PLL circuit 313 to form mixed signals, and the mixed signals are added in the adder 324 to form a transmission signal of one channel. At this time, the phase of a frequency signal supplied to the mixer 322I is shifted by 90° in the phase shifter 323 so that an I-channel signal and a Q-channel signal are quadrature-modulated with each other. Finally, the signal is supplied to the power amplifier 314 through the buffer amplifier 325 so that the signal is amplified to be predetermined transmission electric power. A signal amplified in the power amplifier 314 is supplied to the antenna 303 through the transmit/receive switching device 301 and the high-frequency filter 302 to be transmitted through the antenna 303 by radio. The high-frequency filter 302 functions as a bandpass filter removing a signal component except for a frequency band from a signal to be transmitted or received in the communication device.

On the other hand, when a signal is received in the reception circuit 300B from the antenna 303 through the high-frequency filter 302 and the transmit/receive switching device 301, the signal is processed in the following steps. First, in the high-frequency section 330, the received signal is amplified in the low-noise amplifier 331, and a signal component except for a reception frequency band is removed from the signal in the bandpass filter 341, and then the signal is supplied to the mixer 333 through the buffer amplifier 332. Next, the signal is mixed with a frequency signal supplied from the channel selection PPL circuit 342 so that a predetermined transmission channel signal is formed as a intermediate-frequency signal, thereby the intermediate-frequency signal is supplied to the intermediate-frequency circuit 350 through the buffer amplifier 344. Next, in the intermediate-frequency circuit 350, the intermediate-frequency signal is supplied to the bandpass filter 343 through the buffer amplifier 351 to remove a signal component except for a band of the intermediate-frequency signal to form a substantially constant gain signal in the AGC circuit 352, and the gain signal is supplied to the demodulator 360 through the buffer amplifier 353. Next, in the demodulator 360, the signal is supplied to the mixers 362I and 362Q through the buffer amplifier 361, and then the signal is mixed with a frequency signal supplied from the intermediate-frequency PPL circuit 344 to demodulate an I-channel signal component and a Q-channel signal component. At this time, the signal phase of the frequency signal supplied to the mixer 362I is shifted by 90° in the phase shifter 364, thereby the I-channel signal component and the Q-channel signal component which are quadrature-modulated with each other are demodulated. Finally, the I-channel signal and the Q-channel signal are supplied to the bandpass filters 345I and 345Q, respectively, to remove signal components except for the I-channel signal and the Q-channel signal, and then the I-channel signal and the Q-channel signal are supplied to the ADCs 346I and 346Q, respectively, as digital data. Thereby, I-channel reception data and Q-channel reception data are obtained.

The communication device includes the shunt switch described in the above-described respective embodiment as the transmit/receive switching device 301, so the communication device has superior high-frequency characteristics by functions described in the above-described embodiments.

In addition, in the communication device illustrated in FIG. 28, the case where the shunt switch described in the above-described respective embodiment is applied to the transmit/receive switching device 301 (a semiconductor device) is described, but the communication device is not limited thereto, and, for example, the shunt switch may be applied to the mixers 322I, 322Q, 333, 362I and 362Q, and the bandpass filters 312I, 312Q, 341, 343, 346I and 346Q in the transmission circuit 300A and the reception circuit 300B, and the high-frequency filter 302 (the semiconductor device). Also in this case, the same effects as those described above are obtainable.

Although the present invention is described referring to the embodiments, the invention is not limited thereto, and may be variously modified. For example, the material, thickness of each layer, the film formation method of each layer, and the like are not limited to those described in the above-described embodiments, and each layer may be made of any other material with any other thickness by any other film formation method.

Moreover, in the above-described embodiments, the configurations of the shunt switches 10 and 10A to 10E are described in detail, but it is not necessary to include all components, or any other component may be further included.

The present application contains subject matter related to that disclosed in Japanese Priority Patent Application JP 2009-175190 filed in the Japan Patent Office on Jul. 28, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A shunt switch comprising:

a transmission line that is arranged on a leaf spring formed as one unit with a substrate;

a ground line set to a ground potential, wherein the transmission line and the ground line are arranged on the substrate;

two or more shunt lines electrically coupling the transmission line and the ground line, wherein the two or more shunt lines are arranged in parallel to one another, and an impedance between the two or more shunt lines is higher than an impedance of the transmission line; and a moving section displaceable with respect to the transmission line and/or the ground line, wherein the transmission line is brought into contact with the ground line in response to a displacement of the moving section.

2. The shunt switch according to claim 1, wherein the two or more shunt lines are configured of moving electrodes which are displaceable with respect to the transmission line and/or the ground line.

3. The shunt switch according to claim 2, wherein the moving section is formed as one unit with the substrate, and wherein two or more of the moving electrodes are arranged separately from one another on the moving section, and wherein the two or more moving electrodes are insulated from one another by an insulating film arranged on a surface of the moving section.

4. The shunt switch according to claim 2, wherein the moving section is coupled to a pair of comb electrodes which are engaged with each other, and is displaceable by electrostatic force generated between the pair of comb electrodes.

5. The shunt switch according to claim 2, wherein the moving section is displaceable in a horizontal direction with respect to a surface of the substrate.

6. The shunt switch according to claim 2, wherein the moving section comprises a pushing projection facing a central part of the transmission line, and wherein the pushing projection is brought into contact with the leaf spring in response to the displacement of the moving section so as to deform the leaf spring, thereby the central part of the transmission line is brought into contact with the ground line.

7. The shunt switch according to claim 2, wherein the moving electrodes are displaceable with respect to the transmission line and/or the ground line by deforming the moving electrodes.

8. The shunt switch according to claim 2, wherein the moving section is coupled to a moving electrode for electrostatic drive with a flat spring in between, and is displaceable in a vertical direction with respect to a surface of the substrate by electrostatic force generated between the moving electrode for electrostatic drive and the ground line.

9. A semiconductor device comprising a shunt switch, wherein the shunt switch comprises:

a transmission line that is arranged on a leaf spring formed as one unit with a substrate;

a ground line set to a ground potential, wherein the transmission line and the ground line are arranged on the substrate;

two or more shunt lines electrically coupling the transmission line and the ground line, wherein the two or more shunt lines are arranged in parallel to one another, and an impedance between the two or more shunt lines is higher than an impedance of the transmission line; and a moving section displaceable with respect to the transmission line and/or the ground line, wherein the transmission line is brought into contact with the ground line in response to a displacement of the moving section.

10. A module comprising a semiconductor device which comprises a shunt switch, wherein the shunt switch comprises:

a transmission line that is arranged on a leaf spring formed as one unit with a substrate;

a ground line set to a ground potential, wherein the transmission line and the ground line are arranged on the substrate;

two or more shunt lines electrically coupling the transmission line and the ground line, wherein the two or more shunt lines are arranged in parallel to one another, and an impedance between the two or more shunt lines is higher than an impedance of the transmission line; and a moving section displaceable with respect to the transmission line and/or the ground line, wherein the transmission line is brought into contact with the ground line in response to a displacement of the moving section.

11. An electronic device comprising a semiconductor device which comprises a shunt switch, wherein the shunt switch comprises:

a transmission line that is arranged on a leaf spring formed as one unit with a substrate;

a ground line set to a ground potential, wherein the transmission line and the ground line are arranged on the substrate;

two or more shunt lines electrically coupling the transmission line and the ground line, wherein the two or more shunt lines are arranged in parallel to one another, and an impedance between the two or more shunt lines is higher than an impedance of the transmission line; and a moving section displaceable with respect to the transmission line and/or the ground line, wherein the transmission line is brought into contact with the ground line in response to a displacement of the moving section.

* * * * *